US010194742B2

(12) United States Patent
Meginniss, III et al.

(10) Patent No.: US 10,194,742 B2
(45) Date of Patent: Feb. 5, 2019

(54) DUAL MOTION APPLICATOR FOR A PERSONAL CARE APPLIANCE

(71) Applicant: L'Oreal, Paris (FR)

(72) Inventors: Stephen M. Meginniss, III, Seattle, WA (US); Richard A. Reishus, Renton, WA (US); San Francisco Sabin, Seattle, WA (US)

(73) Assignee: L'Oreal, Paris (FR)

( * ) Notice: Subject to any disclaimer, the term of this patent is extended or adjusted under 35 U.S.C. 154(b) by 361 days.

(21) Appl. No.: 14/986,109

(22) Filed: Dec. 31, 2015

(65) Prior Publication Data

US 2017/0188695 A1 Jul. 6, 2017

(51) Int. Cl.

| | |
|---|---|
| ***A46B 13/02*** | (2006.01) |
| ***A46B 5/00*** | (2006.01) |
| ***A46B 13/00*** | (2006.01) |

(52) U.S. Cl.

CPC ..... *A46B 13/026* (2013.01); *A46B 5/0012* (2013.01); *A46B 13/008* (2013.01); *A46B 2200/1006* (2013.01)

(58) Field of Classification Search

CPC ... A46B 13/026; A46B 13/008; A46B 5/0012; A46B 2200/1006

See application file for complete search history.

(56) References Cited

U.S. PATENT DOCUMENTS

| | | | | |
|---|---|---|---|---|
| 6,032,313 | A | 3/2000 | Tsang | |
| 7,157,816 | B2 | 1/2007 | Pilcher et al. | |
| 7,320,691 | B2 | 1/2008 | Pilcher et al. | |
| 7,386,906 | B2 | 6/2008 | Roth et al. | |
| 7,786,626 | B2 | 8/2010 | Reishus et al. | |
| 2005/0138740 | A1* | 6/2005 | Alfano | A46B 13/008 15/22.1 |
| 2005/0278876 | A1* | 12/2005 | Roth | A46B 13/06 15/28 |
| 2005/0278877 | A1* | 12/2005 | Akridge | A46B 13/008 15/28 |
| 2014/0330289 | A1* | 11/2014 | Revivo | A61B 17/54 606/131 |
| 2015/0333609 | A1* | 11/2015 | Lattanzi | A46B 13/026 310/38 |
| 2016/0037902 | A1* | 2/2016 | Grez | A46B 13/008 15/22.1 |
| 2016/0183670 | A1* | 6/2016 | Brewer | A46B 9/021 15/22.1 |

(Continued)

FOREIGN PATENT DOCUMENTS

| | | |
|---|---|---|
| EP | 2434626 A2 | 3/2012 |

OTHER PUBLICATIONS

International Search Report and Written Opinion dated May 29, 2017, issued in related International Application No. PCT/US2016/068912, filed Dec. 28, 2016, 28 pages.

(Continued)

*Primary Examiner* — Weilun Lo

(74) *Attorney, Agent, or Firm* — Christensen O'Connor Johnson Kindness PLLC

(57) ABSTRACT

An applicator, also referred to as workpiece, is suitable for use with a personal care appliance. The applicator can be in the form of a dual brush head. The dual brush head includes a movable central portion having first and second independently movable sections.

16 Claims, 21 Drawing Sheets

(56) References Cited

U.S. PATENT DOCUMENTS

| | | | | |
|---|---|---|---|---|
| 2016/0183671 | A1* | 6/2016 | Skidmore | A46B 13/02<br>173/162.2 |
| 2016/0331106 | A1* | 11/2016 | Khormaei | A46B 7/08 |
| 2017/0119220 | A1* | 5/2017 | Nichols | A47K 7/043 |
| 2017/0150810 | A1* | 6/2017 | Brewer | A46B 5/0095 |

OTHER PUBLICATIONS

Invitation to Pay Additional Fees dated Mar. 30, 2017, issued in related International Application No. PCT/US2016/068912, filed Dec. 28, 2016, 14 pages.

International Preliminary Report on Patentability and Written Opinion dated Jul. 3, 2018, issued in related International Application No. PCT/US2016/068912, filed Dec. 28, 2016, 21 pages.

* cited by examiner

DUAL MOTION APPLICATOR FOR A PERSONAL CARE APPLIANCE

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one or more aspects of the present disclosure, a workpiece is provided. The workpiece includes an outer section configured to be removably connected to a powered appliance having dual armatures, and an inner section assembly nested within the outer section. The inner section assembly in some embodiments includes first and second inner section members independently rotatable with respect to one another and to the outer section. In some embodiments, the first and second section members are configured to cooperate with one another as the section members are driven in a counter-oscillating manner, wherein the inner section assembly is configured to be driven by movement of the dual armatures when the outer section is connected to the powered appliance.

In accordance with one or more aspects of the present disclosure, a workpiece is provided. The workpiece includes an outer section having an internal cavity, wherein the outer section includes an appliance connection interface and a first applicator connection interface. The workpiece also includes a first applicator section disposed within the internal cavity. The first applicator section includes a drive interface, a second applicator connection interface, and an outer section connection interface. The outer section connection interface is configured to cooperate with the first applicator connection interface such that the first applicator section is retained in the internal cavity and permitted to rotate about an axis independently of the outer section. The workpiece further includes a second applicator section disposed within the internal cavity. The second applicator section includes a first applicator connection interface and a drive interface. The first applicator section connection interface of the second applicator section is configured to cooperate with the second applicator connection interface of the first applicator section such that the second applicator section is retained in the internal cavity and permitted to rotate about said axis independently of the first applicator section.

In accordance with one or more aspects of the present disclosure, a method is provided for reducing vibration imparted by an electric motor to an appliance handle. The electric motor has dual armatures. The method comprises driving, with a first armature of the electric motor, a first workpiece or workpiece section in an oscillating manner about an axis, wherein the workpiece or workpiece section has a first mass moment of inertia about said axis, and driving, with a second armature of the electric motor, a second workpiece or workpiece section in an oscillating manner about said axis and opposite of the oscillating motion of the first workpiece or workpiece section, wherein the second workpiece or workpiece section has a second mass moment of inertia about said axis that is substantially equal to the first mass moment of inertia.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

Figure 1:
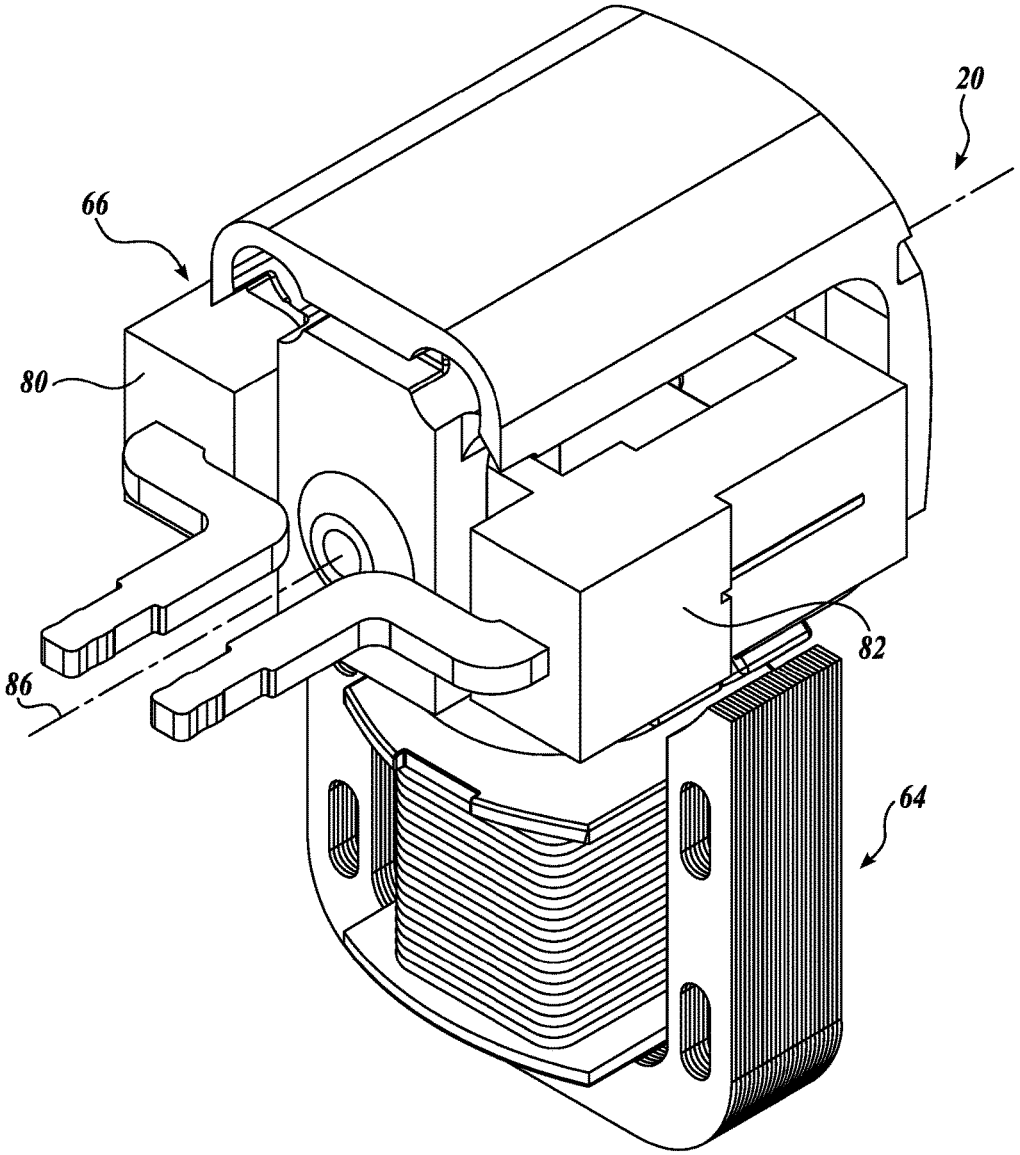
FIG. 1 is a perspective view of one representative embodiment of a dual oscillating electric motor in accordance with one or more aspects of the present disclosure.

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

The present disclosure relates generally to applicators, also referred to as workpieces, suitable for use with a personal care appliance. The present disclosure also relates generally to personal care appliances and their methods of using such applicators.

Generally described, personal care appliances typically use an electric motor to produce a singular workpiece movement/action, which in turn, produces desired functional results. Examples of such appliances include power skin brushes, power toothbrushes and shavers, among others. In some currently available personal care appliances, the electric motor produces singular oscillating (back and forth) action to a singular applicator rather than a purely rotational movement. Examples of such oscillating motors are disclosed in U.S. Pat. No. 7,786,626, or commercially available in Clarisonic® branded products, such as the Aria or the Mia personal skincare product. The disclosures of U.S. Pat. No. 7,786,626, and the Clarisonic® branded products are expressly incorporated by reference herein.

In appliances such as those mentioned above, the oscillating motor is mounted directly to the appliance handle. Vibration generated by the oscillating motor results in vibration transmitted to the handle through its mounts. Such vibration can at the least be bothersome, and in some cases, quite uncomfortable to the user, particularly in an appliance with a small form factor. Additionally, such vibration may result in variations in performance depending on how rigidly the handle is held by the user.

The following discussion also provides examples of an oscillating motor for a personal care appliance that aims to reduce or substantially eliminate vibration transmitted to the appliance handle. In some examples, the oscillating motor imparts suitable oscillating motion to one or more associated workpieces or workpiece sections, also referred to herein as inertial devices. The one or more workpiece or workpiece sections of the personal care appliance can include but is not limited to cleansing brushes, composition applicators, exfoliating brushes, exfoliating discs, toothbrushes, shaving heads, etc.

In order to reduce vibration in the handle, the oscillating motor in one embodiment includes dual workpiece mounts. Each workpiece mount is moved independently by one of the two output drives or armatures of the oscillating motor. In the embodiments described below, the oscillating motor utilizes dual, counter-oscillating armatures. In these and other embodiments, each armature/inertial device is configured to offset the inertia generated by the other of the armature/inertial device, thereby creating zero or almost zero moments about the oscillating axis of the workpiece.

In the following description, numerous specific details are set forth in order to provide a thorough understanding of one or more embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

Turning now to FIG. 1, there is shown an isometric view of one embodiment of an oscillating electric motor, generally designated 20, formed in accordance with an aspect of the present disclosure. The motor 20 is suitable for use with a personal care appliance, such as appliance 22 illustrated in FIG. 2, for providing oscillating motive force or torque to one or more inertial devices, shown in the form of a workpiece, such as, for example, a brush head 28. As will be described in more detail below, the oscillating motor 20 is configured with first and second armatures 80 and 82 that move in an opposing manner. In some embodiments, each armature is adapted to be coupled to an inertia device, such as a workpiece or a workpiece section, in order to provide counter-motion thereto. In other embodiments, one of the armatures is adapted to be coupled to a workpiece for affecting movement of the workpiece while the other armature is adapted to be coupled to a flywheel or other inertial device for offsetting the inertia of the first armature.

Figure 2:
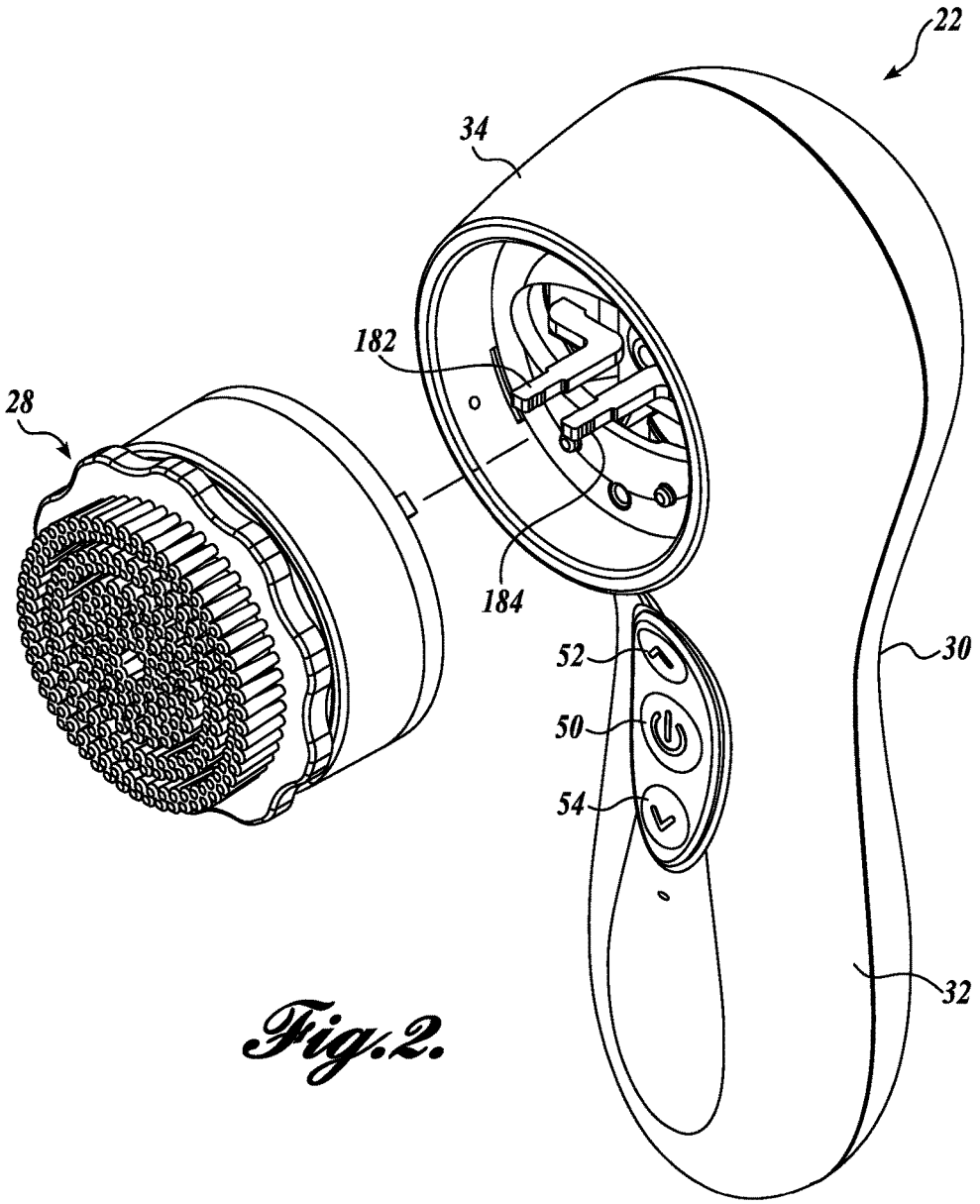
FIG. 2 is a perspective view of one representative embodiment of a personal care appliance suitable for use with the electric motor of FIG. 1.
Figure 3:
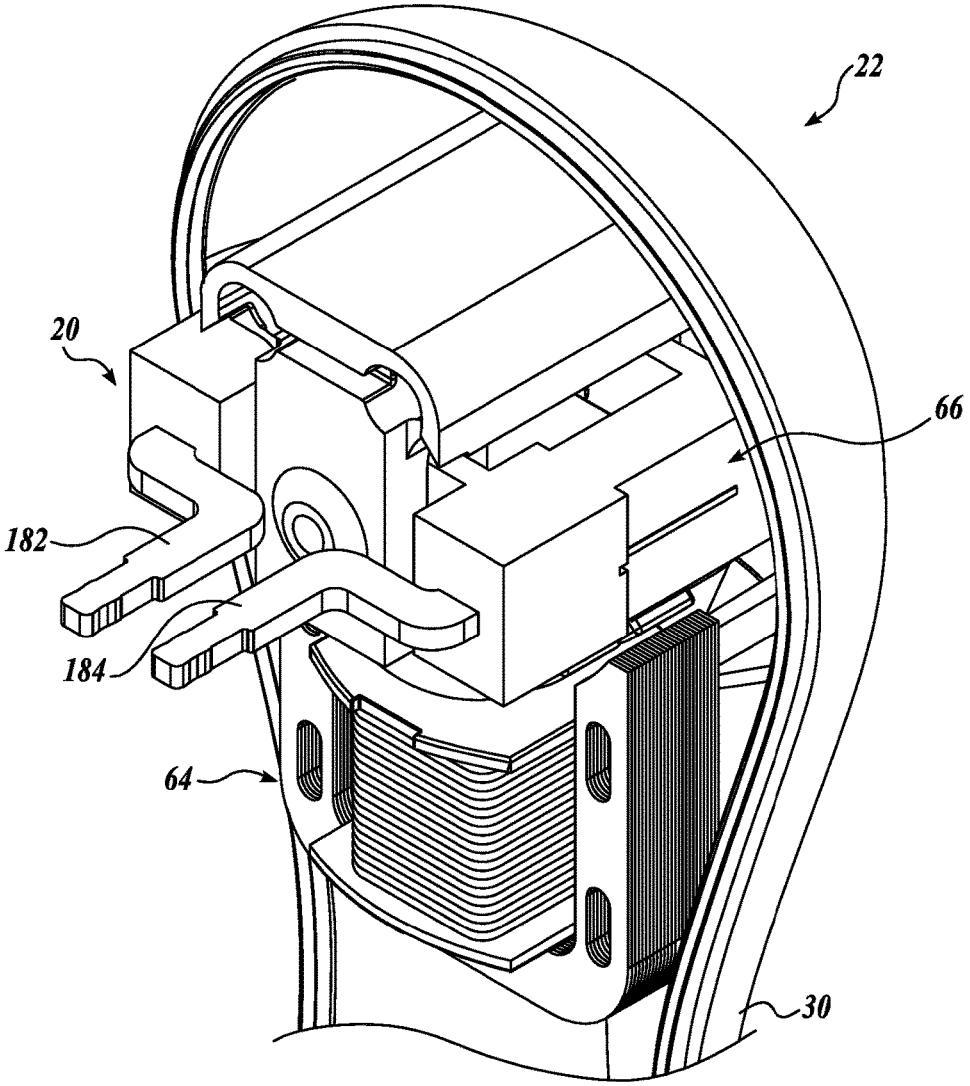
FIG. 3 is a partial perspective view of the personal care appliance of FIG. 2 with the front housing half and workpiece removed.

FIG. 2 is a perspective view of one representative embodiment of a personal care appliance 22 in accordance with an aspect of the present disclosure. FIG. 3 is a partial perspective of the personal care appliance 22 of FIG. 2 with the front housing half and workpiece removed. As shown in FIGS. 2 and 3, the personal care appliance 22 includes a body 30 having a handle portion 32 and a workpiece attachment portion 34. The workpiece attachment portion 34 is configured to selectively attach a workpiece, such as brush head 28, to the appliance 22. While the workpiece is shown as brush head 28 in the embodiment of FIG. 2, it can alternatively include a composition applicator, an exfoliating disc, a shaving head, etc.

Figure 4:
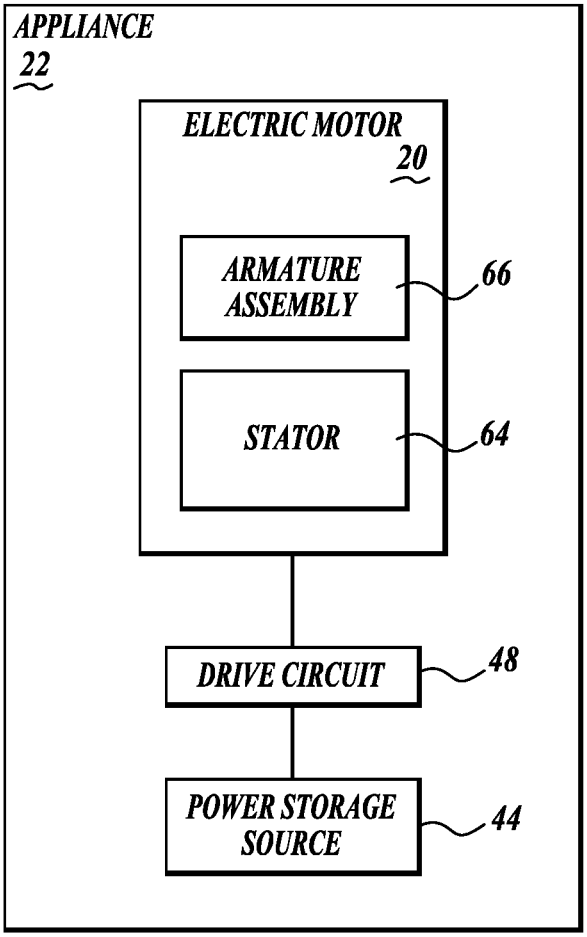
FIG. 4 is block diagrammatic view of the components of one representative embodiment of the dual oscillating electric motor.

The body 30 houses the operating structure of the appliance. As shown in block diagrammatic form in FIG. 4, the operating structure in one embodiment includes the oscillating motor 20, a power storage source, such as a battery 44, and a drive circuit 48 configured and arranged to: (1) selectively generate alternating current at a selected duty cycle from power stored in the battery 44; and (2) deliver alternating current to the oscillating motor 20. In this embodiment, the drive circuit 48 can include an on/off button 50 (See FIG. 2) and optionally includes power adjust or mode control buttons 52 and 54 (See FIG. 2) coupled to control circuitry, such as a programmed microcontroller or processor, which is configured to control the delivery of alternating current to the oscillating motor 20.

Referring now to FIGS. 1, 3, and 5-8, one representative embodiment of the oscillating motor 20 will now be described in more detail. As shown in FIG. 3, the oscillating motor 20 is mounted to or otherwise supported in the handle body 30, and includes a stator 64 and a dual armature assembly 66. The stator 64, sometimes referred to as an electromagnet or field magnet, is mounted against movement to the handle body 30 a spaced distance from the dual armature assembly 66. As shown in top view in FIG. 5, the stator 64 in one embodiment includes an E-core 70 having a center leg 72 upon which a stator coil 74 is wound and two outer legs 76 and 78. In one embodiment, the stator coil 74 is a monofilar or single coil design that utilizes at least 20 gage wire and approximately 50 turns or more. In other embodiments, the stator coil 74 can be a bifilar or dual coil design that utilizes at least 24 gauge wire. In the embodiment shown, the E-core 70 is configured with the center leg 72 being shorter than the two outer legs 76 and 78 such that the tips of the three legs 72, 76, 78 are located along a generally arcuate path. As assembled, the coil 74 is connected to a source of alternating current, such as the battery powered drive circuit 48. In operation, the stator 64 generates a magnetic field of reversing polarity when alternating current is passed through the coil 74 and around center leg 72.

Figure 5:
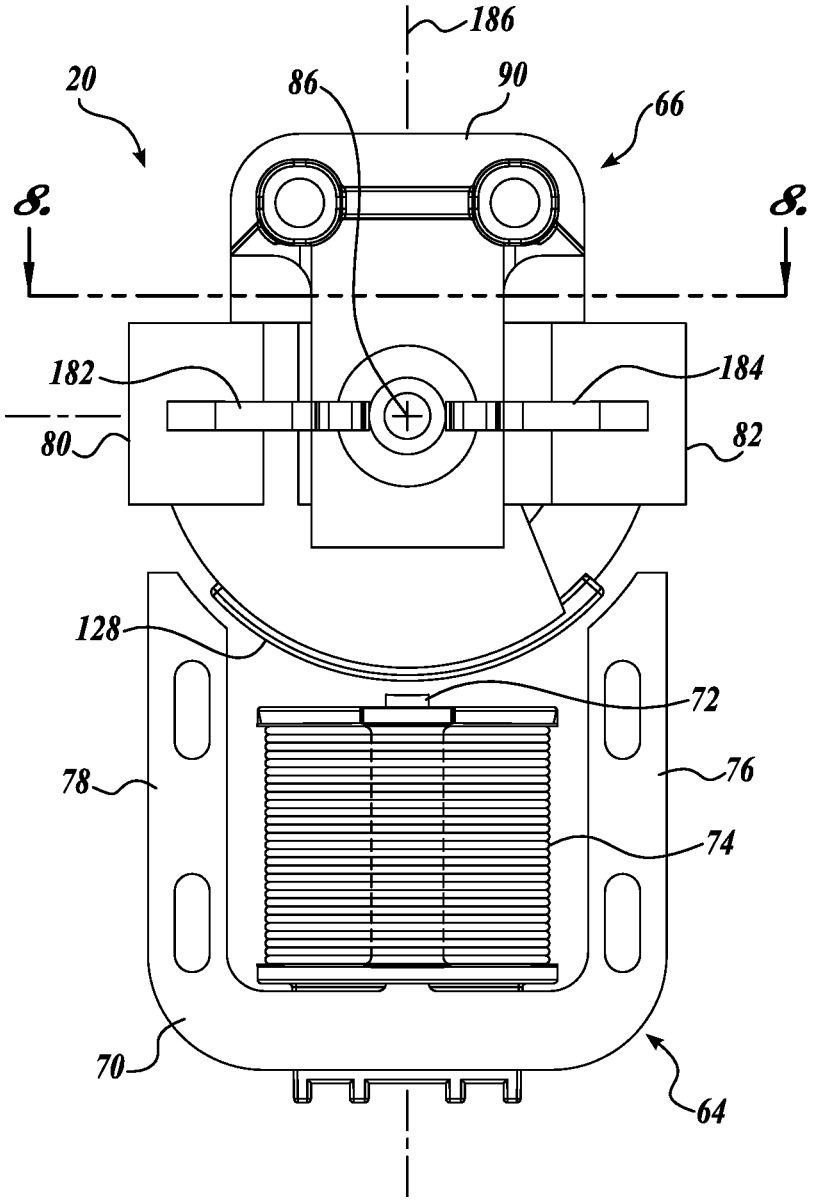
FIG. 5 is a top plan view of the dual oscillating electric motor of FIG. 1.
Figure 6:
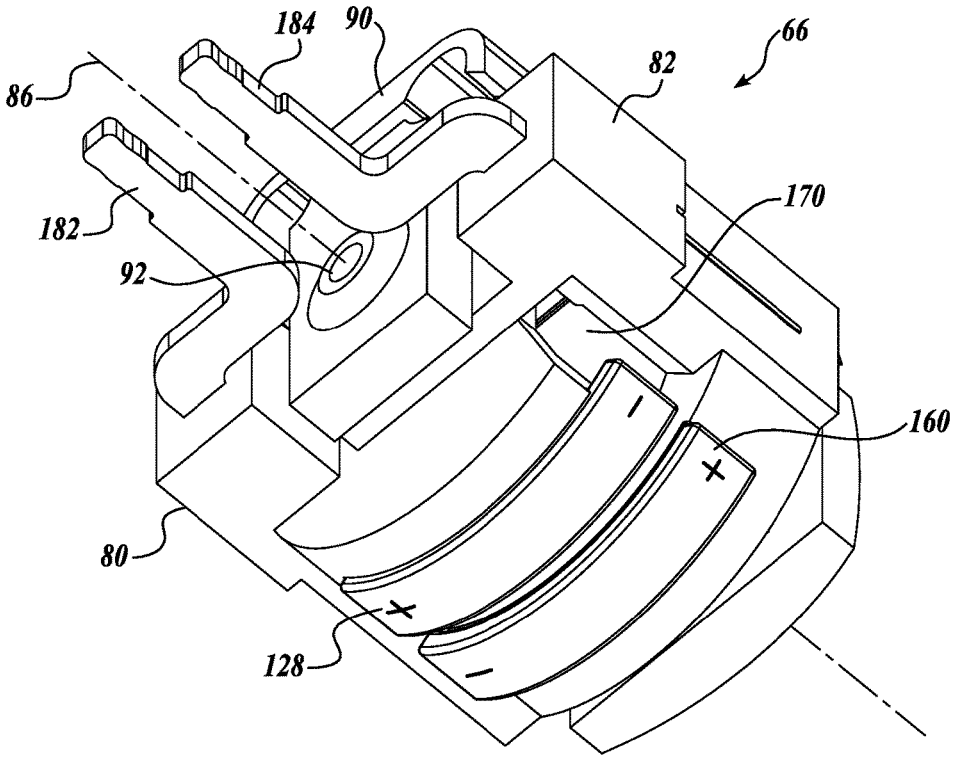
FIG. 6 is a front perspective view of one representative embodiment of an armature assembly in accordance with one or more aspects of the present disclosure.

Referring now to FIGS. 5-6, the dual armature assembly 66 will be described in more detail. As shown in FIGS. 5 and 6, the dual armature assembly 66 includes first and second armatures 80 and 82 mounted for pivotal movement about an armature pivot axis 86. In the embodiment shown in FIGS. 5 and 6, the first and second armatures 80 and 82 are pivotally coupled about axis 86 via an armature mount 90. The armature mount 90 is stationarily mounted to the handle body 30 a spaced distance from the stator 64.

Figure 7:
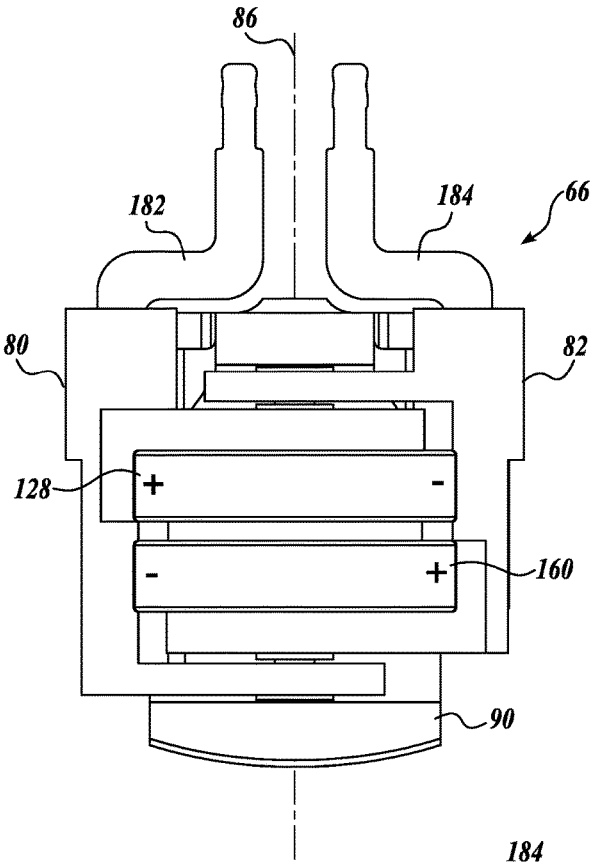
FIG. 7 is a front view of the armature assembly of FIG. 6.
Figure 8:
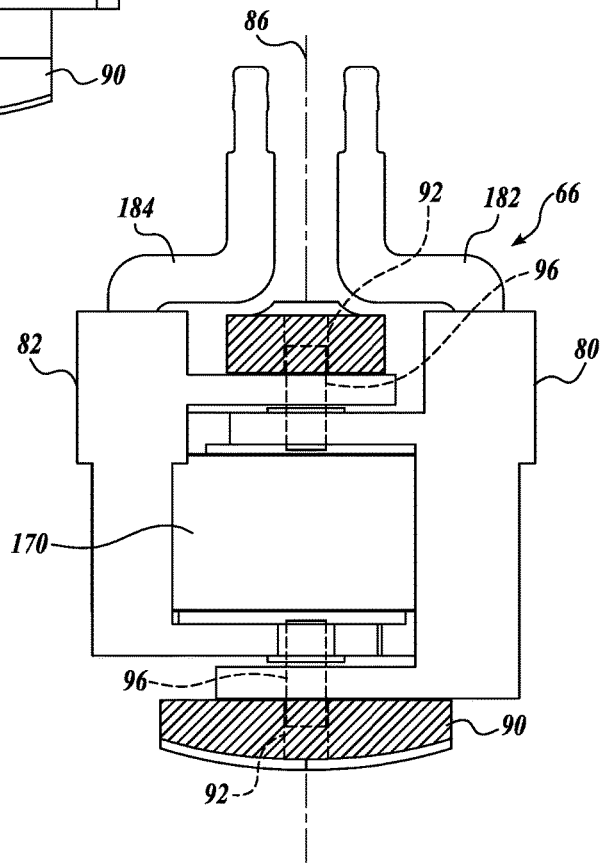
FIG. 8 is a cross sectional view of the armature assembly taken along lines 8-8 in FIG. 5.

In FIGS. 6-8, the armature mount 90 is shown with a somewhat C-shaped body, having an armature mounting interface 92 that defines the armature pivot axis 86. In the embodiment shown, the armature mounting interface 92 includes a pair of aligned bearing surfaces, such as bore holes, formed in parallelly disposed legs of mount 90. As will be described in more detail below, the armature mounting interface 92 cooperatively receives pivot pins 96 or the like associated with the first and/or second armatures 80 and 82 for pivotally mounting the first and second armatures 80 and 82 to the armature mount 90 about the pivot axis 86. When assembled, the armature mount 90 is fixedly secured against movement to the handle body 30, thus becoming a mechanical reference for the oscillating system. While the armature mount 90 is shown in FIGS. 5-8 as a separate component of the dual armature assembly 66, it will be appreciated that the handle body 30 can be configured to carry out the functionality of the armature mount 90.

Figure 9:
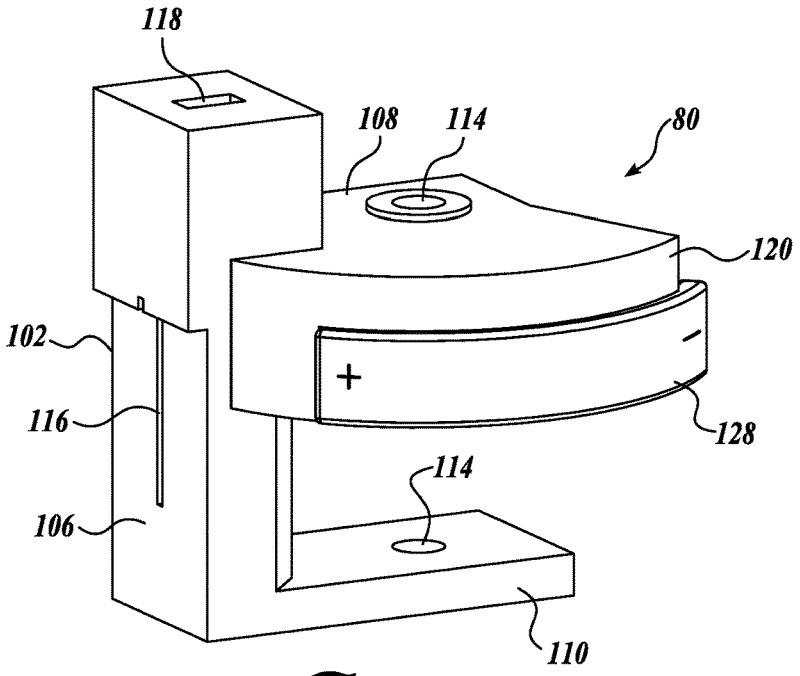
FIGS. 9 and 10 are front and rear perspective views of the first armature of the armature assembly of FIG. 6.
Figure 10:
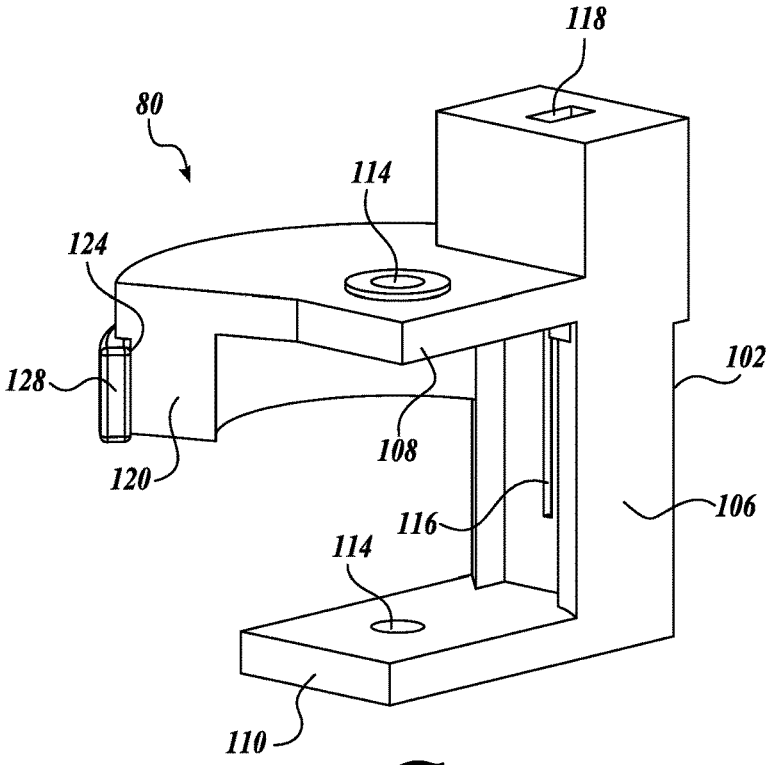

Referring now to FIGS. 6 and 9-10, the first and second armatures 80 and 82 will be described in turn. As shown in front and rear perspective views of FIGS. 9 and 10, the first armature 80 in some embodiments includes a generally C-shaped body 102 comprising an upright post 106 and top and bottom laterally extending legs 108 and 110. Each leg includes a pivot interface, shown as a pivot bore 114, which are aligned in a coaxial manner and are configured to receive pivot pins 96 (See FIG. 8) in order to pivotably couple the first armature 80 to the armature mount 90 via the armature mounting interface 92. When pivotably coupled, the first armature 80 pivots about pivot axis 86. For reasons that will be described in more detail below, the body 102 of the armature 80 also includes a slot 116 and a socket 118 formed in the side and top, respectively, of post 106.

Still referring to FIGS. 9 and 10, an arcuate arm-like member 120 extends generally parallelly with the legs 108 and 110 of the body 102. In one embodiment, the arm-like member 120 is integrally formed or otherwise connected to the top leg 108 and/or the post 106. The arm-like member 120 includes an arcuate outer surface 124 (hidden in FIG. 9) that faces outwardly of the armature 80, and in the direction of the stator when coupled to the armature mount 90 (See FIG. 6). In some embodiments, the arcuate outer surface 124 is configured such that the armature pivot axis 86 forms the center line of the arcuate outer surface 124.

The armature 80 further includes a magnetic device. As shown in FIGS. 9 and 10, the magnetic device includes at least one magnet 128 mounted to the arm-like member 120. In some embodiments, the magnet 128 is curved to match the configuration of the arcuate outer surface 124 and is magnetized laterally from end to end (polarity of the magnet is shown in FIG. 9 as "+" and "−"). In one embodiment, the radius of the inner surface of the curved magnet is about 0.620 inches and the radius of the outer surface of the curved magnet is about 0.690 inches. In this and other embodiments, the height of the magnet ranges from between about 0.225 inches to about 0.400 inches. In these and other embodiments, the arc length of the outer surface of the magnet 128 is between about 1.16 inches and about 1.18 inches. In some embodiments, the magnet 128 is constructed from Neodymium, Iron, and Boron (Nd—Fe—B), and has magnetic properties of N42 and 42 MGOe.

Figure 11:
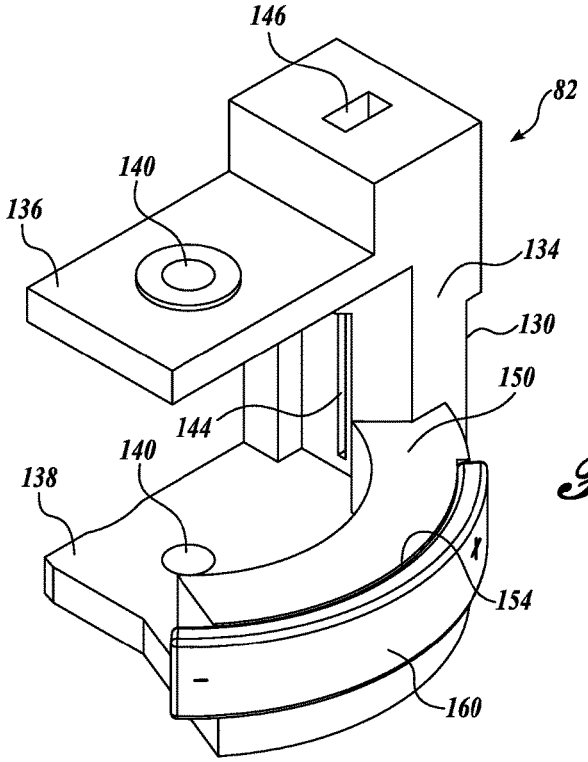
FIGS. 11 and 12 are front and rear perspective views of the second armature of the armature assembly of FIG. 6.
Figure 12:
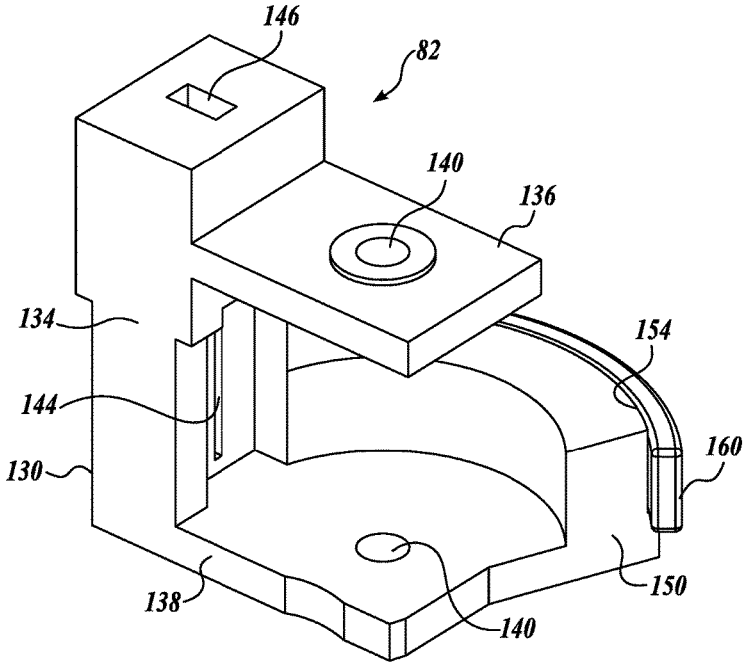

Referring now to FIGS. 6 and 11-12, the second armature 82 will be described. Similar to the first armature 80, the second armature 80 in some embodiments includes a generally C-shaped body 130 comprising an upright post 134 and top and bottom laterally extending legs 136 and 138, as shown in the front and rear perspective views of FIGS. 11 and 12. Each leg includes a pivot interface, shown as a pivot bore 140, which are aligned in a coaxial manner and are configured to receive pivot pins 96 in order to pivotably couple the second armature 82 to the armature mount 90 via the armature mounting interface 92. When pivotably coupled, the second armature 82 pivots about pivot axis 86. For reasons that will be described in more detail below, the body 130 of the second armature 82 also includes a slot 144 and a socket 146 formed in the side and top, respectively, of post 134.

Still referring to FIGS. 11 and 12, an arcuate arm-like member 150 extends generally parallelly with the legs 136 and 138 of the body 102. In one embodiment, the arm-like member 150 is integrally formed or otherwise connected to the bottom leg 138 and/or the post 134. The arm-like member 150 includes an arcuate outer surface 154 that faces outwardly of the second armature 82, and in the direction of the stator when coupled to the armature mount 90. In some embodiments, the arcuate outer surface 154 is configured such that the armature pivot axis 86 forms the center line of the arcuate outer surface 154.

The second armature 82 further includes a magnetic device. As shown in FIG. 11, the magnetic device includes at least one magnet 160 identically configured as magnet 128 and mounted to the arm-like member 150. In one embodiment, the magnet 160 is curved to match the configuration of the arcuate outer surface 154 and is magnetized laterally from end to end (polarity of the magnet is shown in FIG. 11 as "+" and "−"). As assembled, the first and second armatures 80 and 82 are pivotably mounted to the armature mount 90 via pivot pins 96, the arm-like members 120 and 150 are interleaved with one another, and the position and orientation of the magnets 128 and 160 are such that they are aligned top to bottom and are magnetized with opposite polarities as shown, for example, in FIG. 6.

In order to aid in the reduction of vibration, the first and second armatures are configured in some embodiments so as to have the same or substantially the same mass moments of inertia about pivot axis 86. Alternatively or additionally, the first and second armatures are configured in some embodiments so that the centroid of each armature is centered on axis 86, thereby aiding in the reduction of vibration. In some of these embodiments, either weights or extra material can be added to one or both of the armatures or material or weigh can be removed from one or both of the armatures in order to provide equal mass moments of inertia about pivot axis 86 and/or to have the centroid of each armature centered on axis 86.

Returning to FIGS. 6-8, the armature assembly 66 also includes a linkage or joint, shown as at least one flexure element 170, which interconnects the first and second armatures 80 and 82. In one embodiment, the flexure element 170 is made from a spring steel material, and has a generally rectangular cross section. In one embodiment, the flexure element 170 is, for example, approximately 0.025 inches thick and approximately 0.50 inch high, and spans between the posts 106 and 134 of the first and second armatures 80 and 82, respectively. When assembled, the ends of the flexure element 170 are coupled to the first and second armatures 80 and 82 by insertion, molding, etc., into the co-planar slots 116 and 144 of posts 106 and 134 respectively. In the embodiment shown, the co-planar slots 116 and 144 are oriented generally parallel with the pivot axis 86. Once coupled, the flexure element 170 is disposed orthogonal to the central axis of the motor. In one embodiment, the flexure element is bisected by the axis 86 (see FIG. 5), which is the pivot point about which armatures 80 and 82 oscillate. Such symmetrical arrangement of flexure element 170 produces almost pure bending stress on element 170 and almost no shear stress.

Referring to FIG. 6, the armature assembly 66 further includes first and second mounting arms 182 and 184, sometimes referred to as device mounts or mounting interfaces, which extend from the top of armatures 80 and 82, respectively. Adapted to be mounted on the free end of mounting arms 182 and 184 are inertial devices, such as a workpiece or workpiece sections. Quick release mounting discs can be used in some embodiments for coupling the mounting arms to the inertial devices. In some embodiments, weights or material can be either added or subtracted, as needed, so that the mass centroid of the system is centered on axis 86. Addition or subtraction of weight or material can also be implemented to so that first armature/mounting disc as the identical or substantially identical mass moment of inertia about axis 86 as the second armature/mounting disc. In some embodiments, one of the inertial devices is a flywheel, a tuning mass, and/or the like, while the other of the inertial devices is a single workpiece or brush. The configuration of the mounting arms 182 and 184 in conjunction with the workpiece sections is such that the inertial devices each oscillate about axis 86. In the embodiment shown, the first and second mounting arms 182 and 184 are secured to the first and second armatures 80 and 82 via sockets 118 and 146, respectively. It will be appreciated that other configurations are possible to affix the mounting arms to the armatures. In some embodiments, the mounting arms 182 and 184 are co-planar with the flexure element 170, when affixed to the armatures. In some embodiments, the first and second mounting arms 182 and 184 are symmetrically disposed with respect to the longitudinal axis of the motor, generally designed 186, as shown in FIG. 5. In these and other embodiments, the first and second mounting arms 182 and 184 lie in a plane that is orthogonal to the longitudinal axis 186.

Figure 13C:
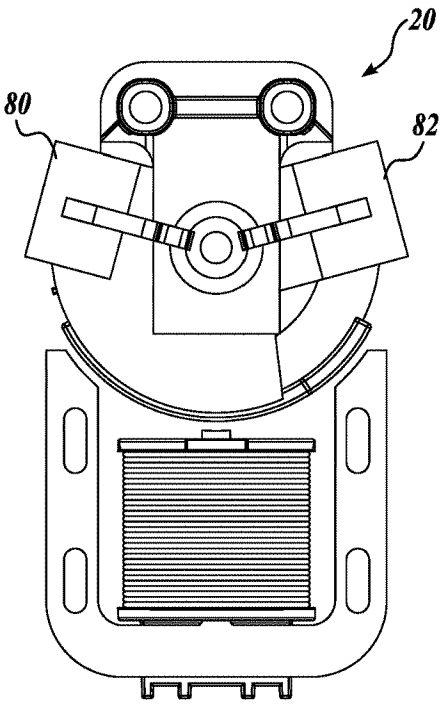
FIGS. 13*a*-13*c* are top views of the oscillating motor showing the opposing motion of the first and second armatures.
Figure 13B:
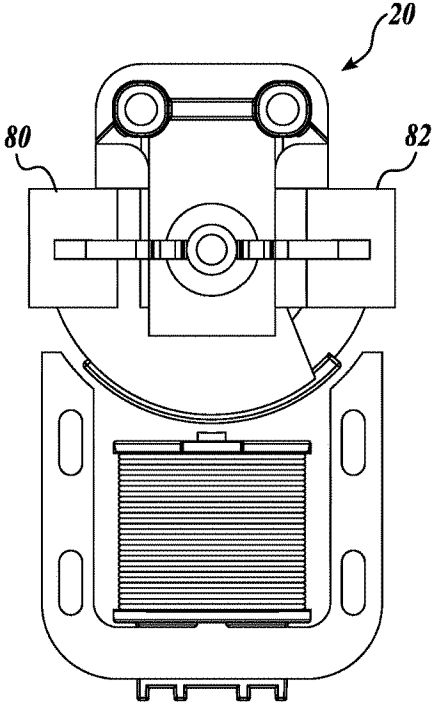

Operation of the electric motor 20 will now be described with reference to FIG. 4, and 13*a*-13*c*. In its "off" or non-energized state, the first armature and the second armature are centered with respect to the stator and the flexure element is in an unflexed position, as shown in FIG. 13*b*. When alternating current is supplied to the stator coil 74 from the battery powered drive circuit 48, the stator 64 generates a magnetic field of reversing polarity. As a result, the first and second armatures 80 and 82 are driven in opposing, oscillating arcuate paths about axis 86 due to the attractive/repulsive action between the magnetic field of reversing polarity generated by the stator 64 and the polarity of the curved magnets 128 and 160. The opposing movement of the armatures oscillates between the positions illustrated in FIGS. 13*a* and 13*c*.

Figure 13A:
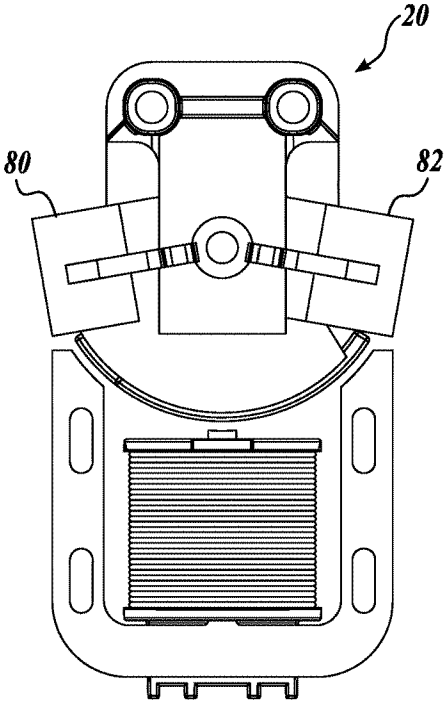
Figure 14:
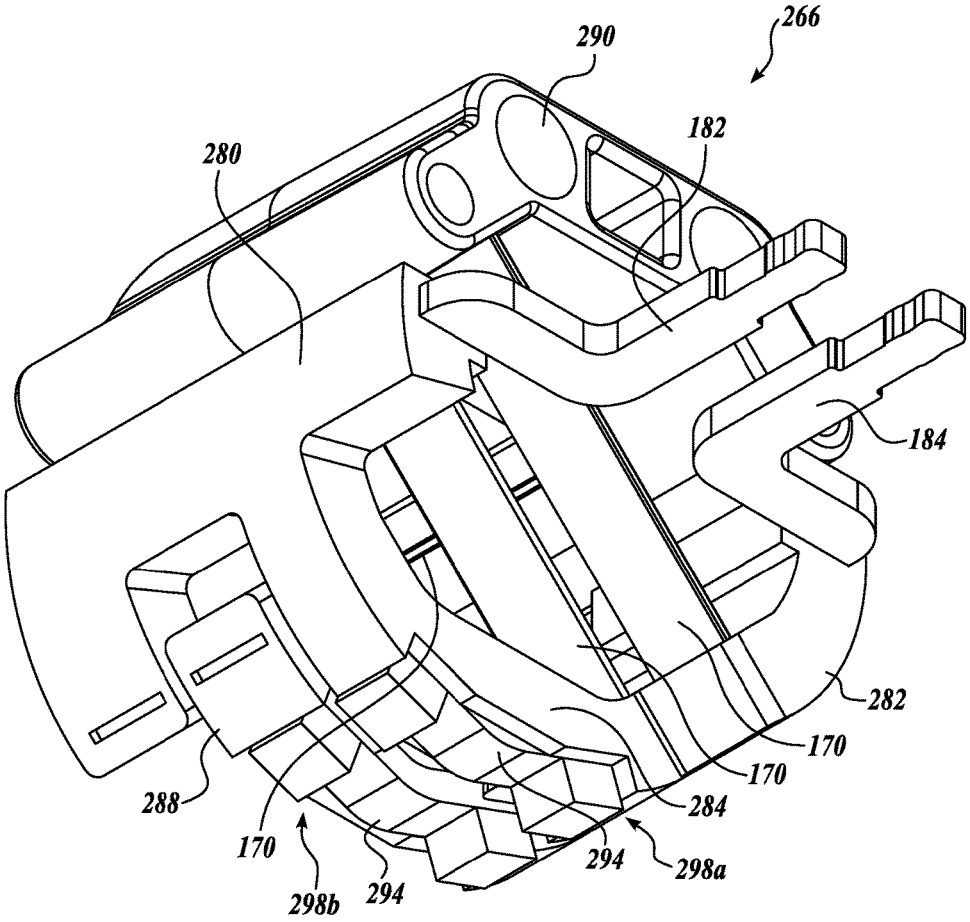
FIG. 14 is a perspective view of another representative embodiment of an armature assembly in accordance with one or more aspects of the present disclosure.
Figure 15:
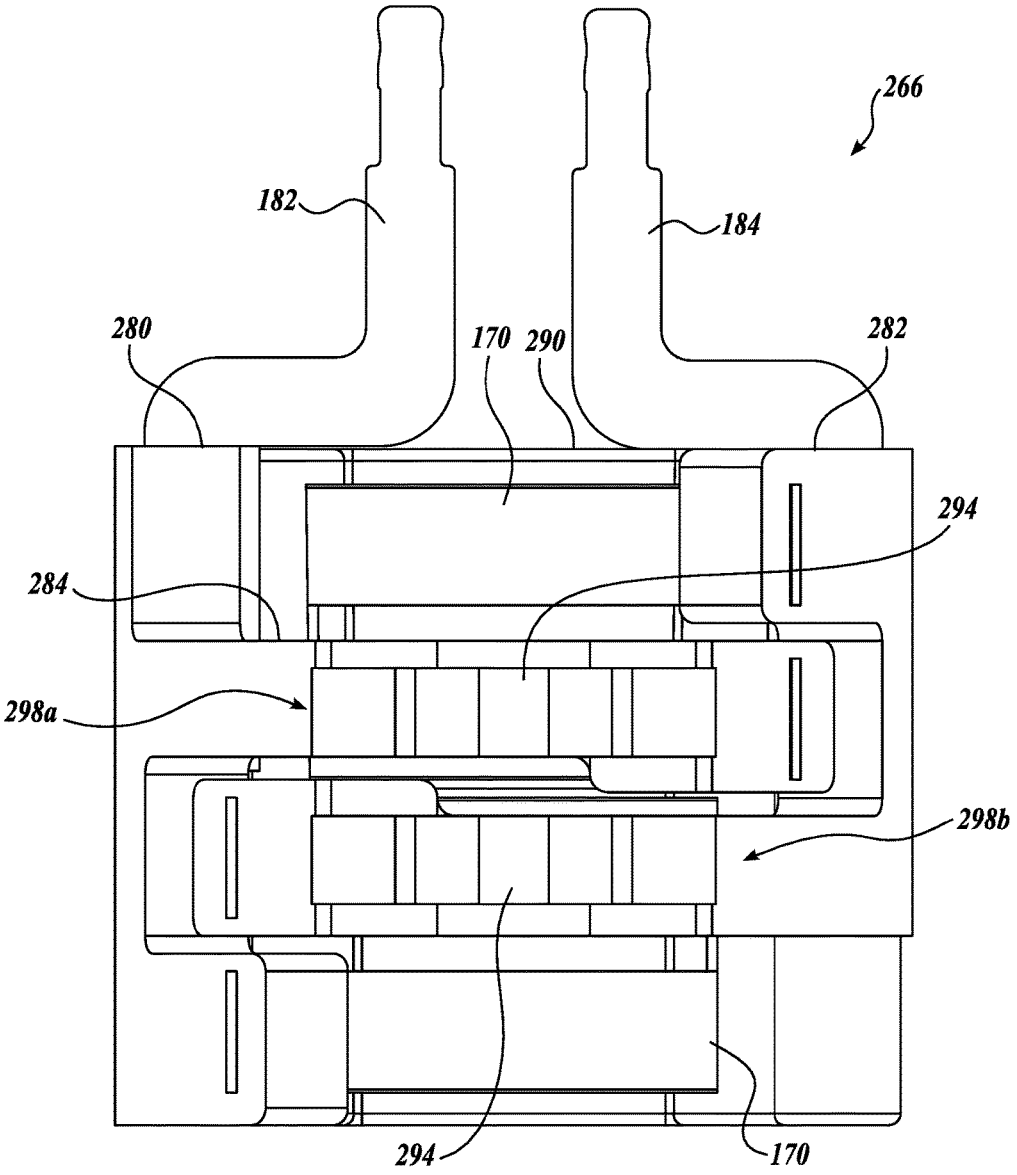
FIG. 15 is a front view of the armature assembly of FIG. 14.
Figure 16:
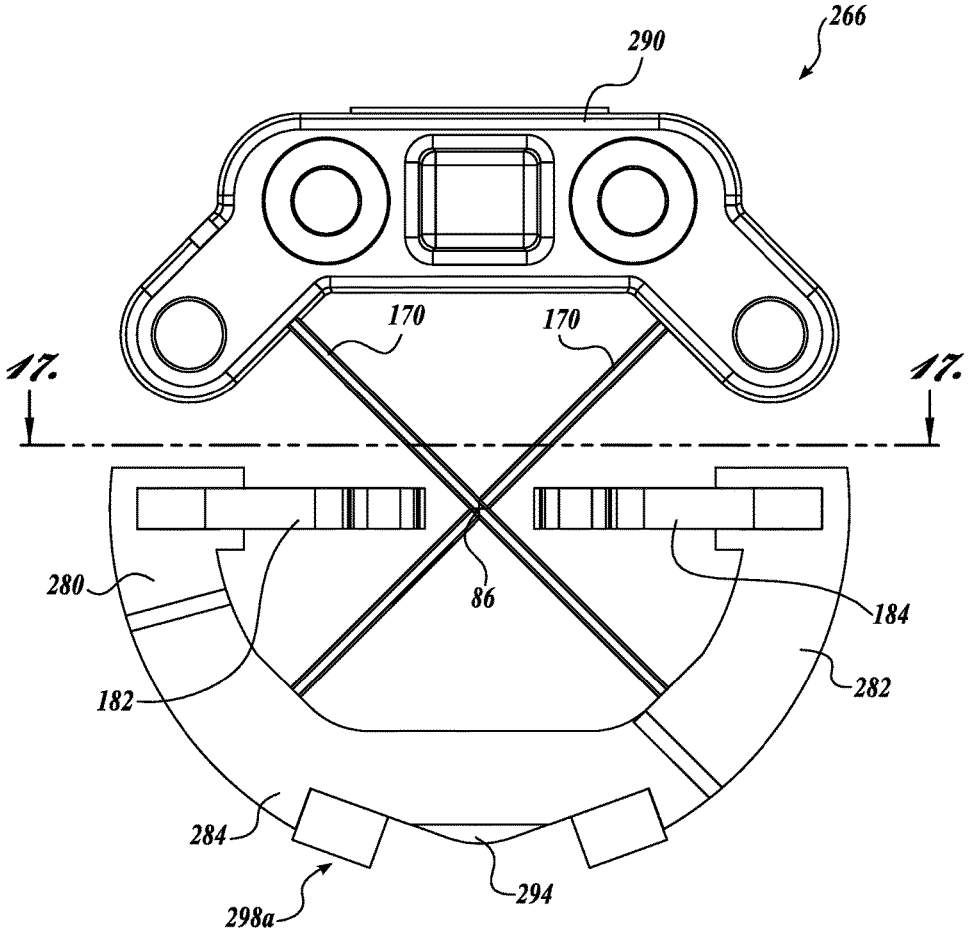
FIG. 16 is a top plan view of the armature assembly of FIG. 14.
Figure 17:
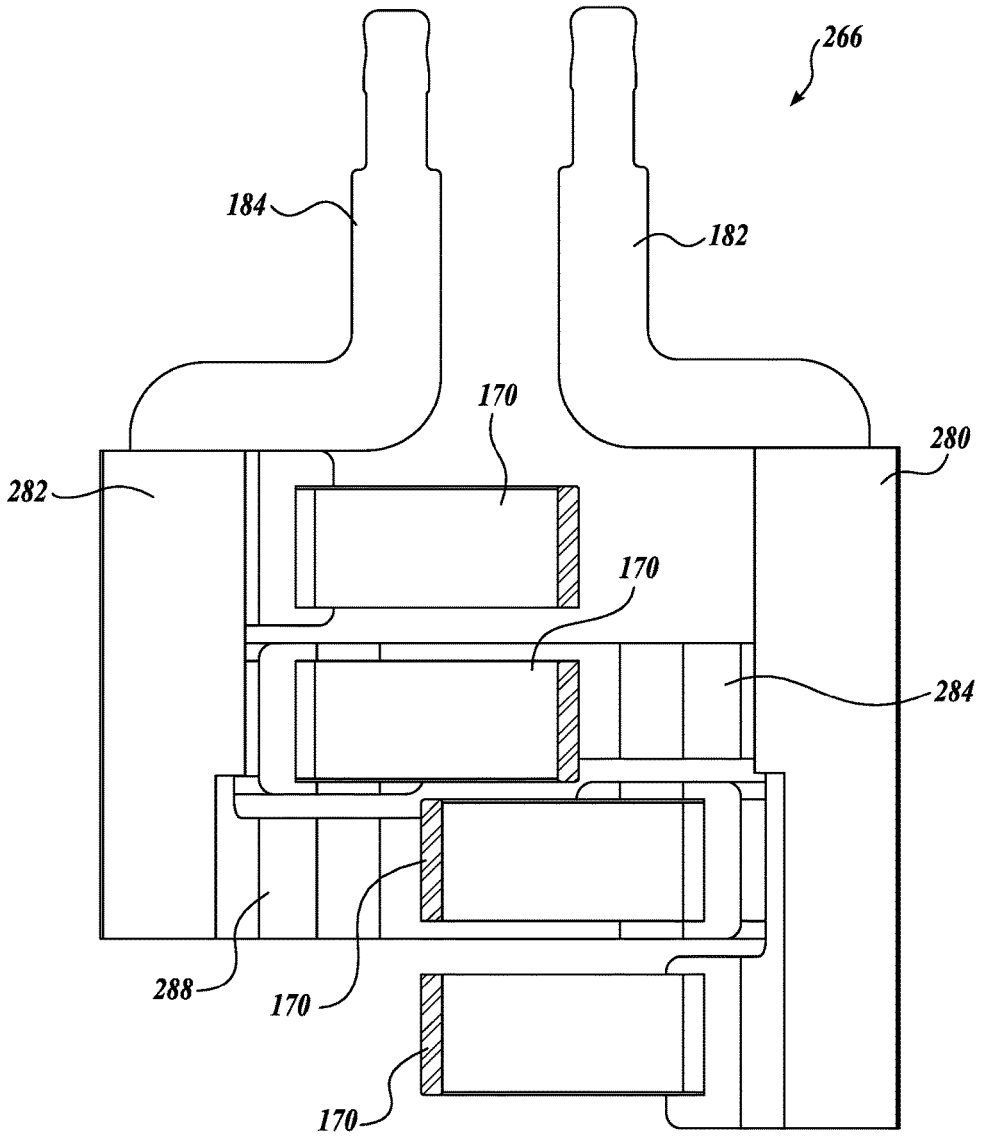
FIG. 17 is a cross sectional view of the armature assembly taken along lines 17-17 in FIG. 16.

In some embodiments, as was described in some detail above, the mass moment of inertia of the first armature about axis 86 is identical to the mass moment of inertia of the second armature about axis 86. Accordingly, as the first and second armatures rotate counter to one another as shown in FIGS. 13*a*-13*c*, the mass moment of inertia generated by the first armature is canceled out by the mass moment of inertia generated by the second armature. Moreover, in some embodiments, the centroids of the first and second armatures are centered about axis 86. As such, vibration imparted to the appliance handle by the motor can be reduced or eliminated. Additional benefits of a balanced or nearly balanced armature assembly are also present. For example, when balanced or nearly balanced, the stator pushes with equal or near equal and opposite magnetic force on the magnets of the armatures so that there is little or no net force imparted to the appliance handle.

In some embodiments, the armatures are magnetically self-centering in relation to the stator 64 and are not centered by mechanical means. In some embodiments, the angular range of oscillation can be varied, depending upon the configuration of the armature and the stator and the characteristics of the alternating drive current. In some embodiments, the motion in one of various settings (e.g., low, normal, high, pro, etc.) is within the range of 3 to 15 degrees or more about the pivot axis. In some embodiments, the duty cycle of the oscillating motor is between about 25% and 49%. In one embodiment, the duty cycle of the oscillating motor is about 30%, and the armatures oscillate at a frequency of about 113 Hz.

FIGS. 14-17 illustrate another embodiment of an armature assembly 266 in accordance with one or more aspects of the present disclosure. The armature assembly 266 is similar to the construction and operation of assembly 66 described above except for the differences that will now be described in more detail. The armature assembly 266 is suitable for use with the stator 64 described above, forming another embodiment of an oscillating electric motor in accordance with one or more aspects of the present disclosure. As shown in FIG. 14-17, the armature assembly 266 includes first and second armatures 280 and 282 mounted for approximate movement about an axis 86 by a flex pivot described below. The first and second armatures 280 and 282 of the armature assembly 266 include lateral arm members 284 and 288, respectively, of a somewhat curved configuration, which are configured to interleave with the other. Each lateral arm includes a ferromagnetic, back iron member 294. Spaced apart magnet pairs 298*a* and 298*b* are mounted on the back iron member 294 of armatures 280 and 282, respectively, with magnetization in the radial direction. The magnet pairs 298*a* and 298*b* are arranged such that the north pole of one magnet of the magnet pair faces outwardly while the north pole of the other magnet of the magnet pair faces inwardly. It should be understood, however, that the orientation could be reversed as long as the magnet poles point in opposite directions. It will be appreciated that the polarity of the magnet pairs 298*a* and 298*b* are reversed.

In some embodiments, each back iron member 294 includes two surfaces disposed at an angle to one another onto which the magnets of each magnet pair 298*a* and 298*b* are mounted. Examples of magnets that can be practiced with embodiments of the present disclosure are set forth in or employed by the prior art motor configurations. As assembled, the position and orientation of the magnet pairs are such that a line normal to the face of the magnets, passing through the midpoint of the magnet face, also passes through the virtual axis 86. To provide a mechanical means of self-centering of the armatures, equalizers or the like are employed in some embodiments. The equalizer mechanism in some embodiments includes a small rocker arm with a center shaft mounted on the appliance chassis and a slot at each end that is connected to each armature in a slider-crank fashion so that the armatures return to the neutral position when either the power is off or current is supplied to the stator. With the equalizers, the first and second armatures are restricted to move cyclically in equal rotations in opposite directions in phase with the alternating current provided to the stator.

In order to aid in the reduction of vibration, the first and second armatures 280 and 282 are configured in some embodiments of the present disclosure so as to have the same or substantially the same mass moments of inertia about virtual pivot axis 86. Alternatively or additionally, the first and second armatures 280 and 282 are configured in some embodiments so that the centroid of each armature is centered on or close to virtual pivot axis 86, thereby aiding in the reduction of vibration. In some of these embodiments, either weights or extra material can be added to one or both of the armatures or material or weigh can be removed from one or both of the armatures in order to provide equal mass moments of inertia about virtual pivot axis 86 and/or to have the centroid of each armature centered on or close to virtual pivot axis 86.

The armature assembly 266 also includes an armature mount 290, which is secured to the body 30 of the appliance 22 (See FIG. 2), thus becoming a mechanical reference for the oscillating system. The first and second armatures 280 and 282 are coupled to the armature mount 290 by a plurality of fixture elements 170, shown as pairs of flexure elements 170 in this embodiment. Pairs of flexure elements 170 are oriented approximately perpendicular to each other and overlap at axis 86, which is the functional pivot point about which the first and second armatures oscillate. In the embodiment shown, one flexure element 170 of the flexure pair extends between first armature 280 and the armature mount 290, while the other flexure element 170 of the flexure pair extends between the second armature 282 and the armature mount 290.

Extending from the first and second armatures 280 and 282 are first and second mounting arms 182 and 184. As can be seen most clearly in FIGS. 14 and 15, the mounting arms 182 and 184 extend outwardly from the armatures and then extends horizontally inwardly toward the axis and then extends outwardly again approximately at a right angle. Mounted on the free end of mounting arms 182 and 184 are inertial devices, such as workpieces, etc., either directly or indirectly via drive hubs, quick release mounting discs, among others. In some embodiments, the first and second mounting arms 182 and 184 are symmetrically disposed with respect to the longitudinal axis of the motor. In these and other embodiments, the first and second mounting arms 182 and 184 lie in a plane that is orthogonal to the virtual longitudinal axis 186 and that is coincident with the axis 86.

Figure 18:
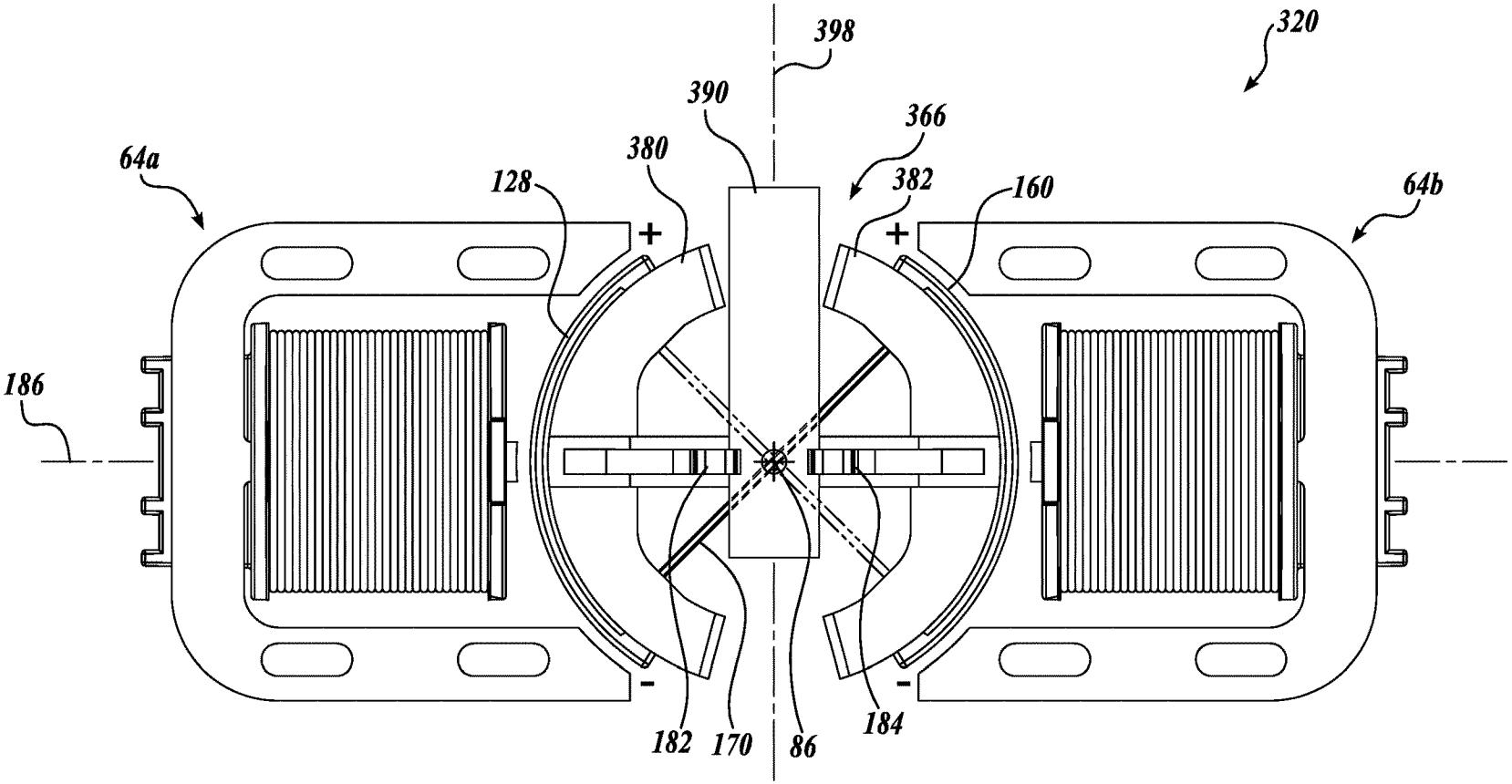
FIG. 18 is a perspective view of another representative embodiment of a dual oscillating electric motor in accordance with one or more aspects of the present disclosure.

FIG. 18 illustrates another embodiment of an oscillating electric motor 320 in accordance with one or more aspects of the present disclosure. The oscillating electric motor 320 is substantially identical to the construction and operation of motor 20 described above except for the differences that will now be described in more detail. As best shown in FIG. 18, the motor 320 includes first and second stators 64*a* and 64*b* and an armature assembly 366. In the embodiment shown, the first and second stators 64*a* and 64*b* are positioned on opposite sides of the armature assembly 366, and the first and second armatures 380 and 382 are in general alignment with the stators 64*a* and 64*b*, respectively.

Still referring to FIG. 18, the first and second armatures 380 and 382 are pivotably coupled to opposing sides of a generally C-shaped armature mount 390 about axis 86. First and second armatures 380 and 382 include lateral arm members 384 and 388 of a somewhat curved configuration onto which a magnetic device, such as curved magnets 128 and 160, are mounted. As mounted, the curved magnets 128 and 160 face outwardly toward the stators 64*a* and 64*b*, respectively. In some embodiments of the present disclosure, the first and second armatures 380 and 382 are configured so as to have the same or almost the same mass moments of inertia about pivot axis 86. In some embodiments, the centroid or approximate centroid of each armature is centered or almost centered on axis 86.

The armature assembly 366 also includes a linkage or joint, shown as at least one flexure element 170, which interconnects the first and second armatures 380 and 382. In one embodiment, the flexure element spans between the outer ends of the armatures' lateral arm members 384 and 388, as shown in FIG. 18. In this embodiment, the flexure element 170 extends through the rotational axis 86. In one embodiment, the flexure element 170 is bisected by the axis 86, which is the pivot point about which armatures 380 and 382 oscillate. Again, such an arrangement of flexure element 170 produces almost pure bending stress on element 170 with almost no shear stress. In other embodiments, an additional flexure element (shown in broken lines in FIG. 18) may be provided, and oriented orthogonal to the flexure element 170.

In order to aid in the reduction of vibration, the first and second armatures 380 and 382 are configured in some embodiments of the present disclosure, so as to have the same or substantially the same mass moments of inertia about pivot axis 86. Alternatively or additionally, the first and second armatures 380 and 382 are configured in some embodiments so that the centroid of each armature is centered on axis 86, thereby aiding in the reduction of vibration. In some of these embodiments, either weights or extra material can be added to one or both of the armatures or material or weigh can be removed from one or both of the armatures in order to provide equal mass moments of inertia about pivot axis 86 and/or to have the centroid of each armature centered on axis 86.

The armature assembly 366 further includes first and second mounting arms 182 and 184, sometimes referred to as device mounts or mounting interfaces, which extend from the top of armatures 380 and 382, respectively. Adapted to be mounted on the free end of mounting arms 182 and 184 are inertial devices, such as a workpiece or workpiece sections, either directly or indirectly via mounting discs, drive hubs, etc. If mounting discs, drive hubs, etc., are employed, it will be appreciated that their centroid or approximate centroid is centered on axis 86. In some embodiments, one of the inertial devices is a flywheel, a tuning mass, and/or the like. The configuration of the mounting arms 182 and 184 in conjunction with the workpiece sections is such that the inertial devices each oscillate about axis 86. In some embodiments, the mounting arms 182 and 184 are co-planar with the longitudinal axis 186. In some embodiments, the first and second mounting arms 182 and 184 are symmetrically disposed with respect to the lateral axis of the motor, generally designated 398.

Figure 19:
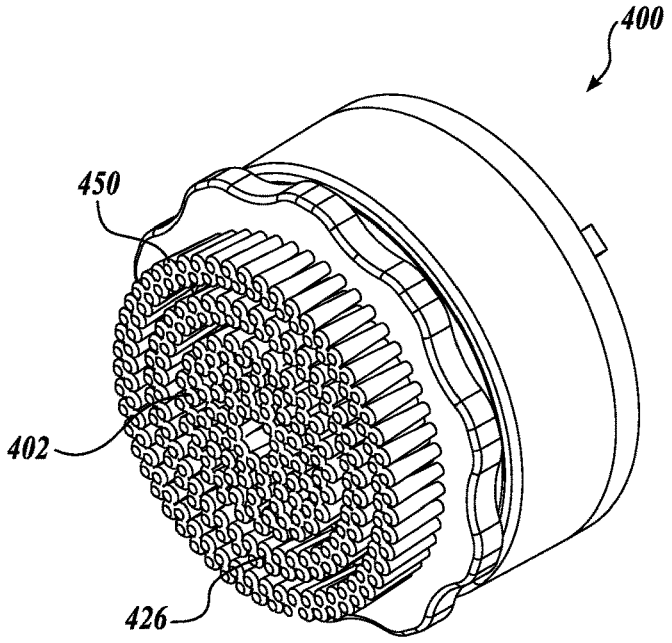
FIG. 19 is a perspective view of one representative embodiment of a workpiece, depicted as a dual brush head, in accordance with one or more aspects of the present disclosure, that is suitable for use with the appliance of FIG. 2, the motors of FIGS. 1 and 18, and the armature assembly of FIG. 14.
Figure 20:
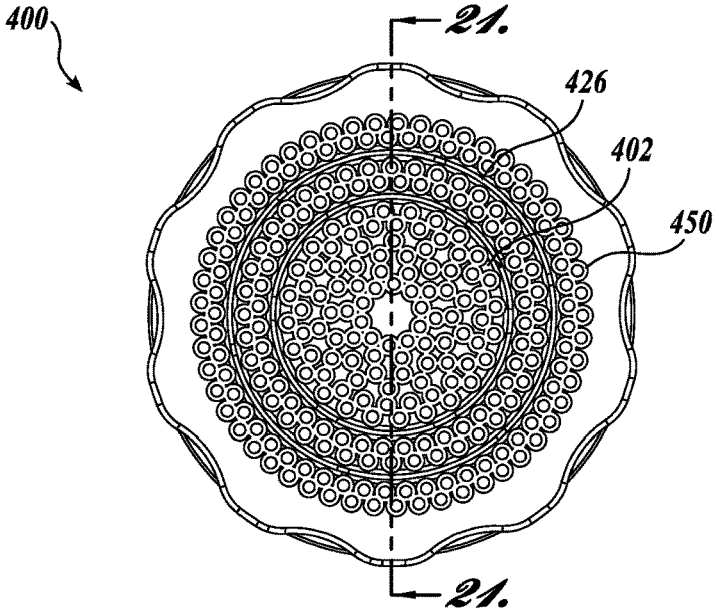
FIG. 20 is a top view of the workpiece of FIG. 19.
Figure 21:
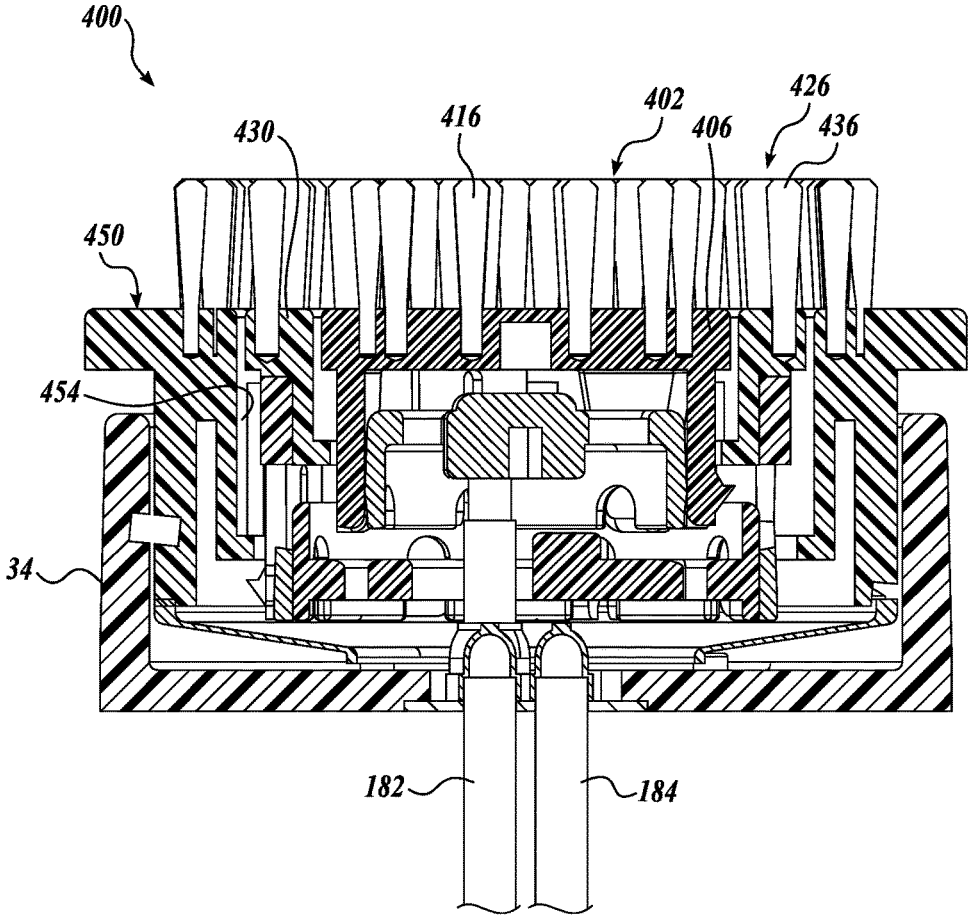
FIG. 21 is a cross sectional view of the workpiece taken along lines 21-21 in FIG. 20.

FIGS. 19-21 illustrate one representative embodiment of a workpiece 400 in accordance with one or more aspects of the present disclosure. The workpiece is in the form of a brush head suitable for use with the armature assemblies 66, 266, and 366, described above. As shown in FIGS. 19-21, the dual brush head 400 includes a movable central portion 402. The movable central portion 402 includes a generally cylindrical body 406 configured to interface directly or indirectly via, for example, mounting discs or the like with one of the mounting arms 182 and 184 of the armature assembly 66, 266, 366 at a first or inner end. The body 406 is shown in FIG. 21 as being constructed out of plastic, such as nylon, polypropylene, polyurethane, polyethylene, etc., although other materials may be utilized, including lightweight metals, such as aluminum, titanium, etc.

The movable central portion 402 further includes an applicator in the form of a group of bristled tufts 416. The tufts 416 are spaced apart from one another and include a plurality (e.g., 120-180) of filaments. The filaments extend upwardly from the outer surface of the body 406. In some embodiments, the filaments of the tufts 416 have a height of about 0.360 inches (9.144 millimeters) to 0.400 inches (10.160 millimeters) or greater and a diameter in the range of about 0.003 inches (0.0762 millimeters) to 0.006 inches (0.152 millimeters). The filaments can be constructed out of a variety of materials, such as polymers and co-polymers. In some embodiments, the bristles may be constructed out of polybutylene terephthalate (PBT), polyethylene terephthalate (PET), nylon, polyester, a thermoplastic elastomer (TPE), combinations thereof, etc.

Still referring to FIGS. 19-21, the dual brush head 400 further includes a movable outer portion 426 that surrounds the central portion 402 and is independently movable therewith. In that regard, the outer portion 426 includes a general ring-like body 430 configured to interface directly or indirectly via, for example, mounting discs or the like with the other one of the mounting arms 182 and 184 of the armature assembly 66, 266, 366. Similar to the central portion 402, the body 430 can be constructed out of plastic, such as nylon, polypropylene, polyurethane, polyethylene, etc., although other materials may be utilized, including lightweight metals, such as aluminum, titanium, etc.

The movable outer portion 426 further includes an applicator in the form of a group of bristled tufts 436. The tufts 436 are spaced apart from one another and include a plurality (e.g., 120-180) of filaments. In some embodiments, the filaments of the tufts 436 are substantially identical to the filaments of tufts 416. The dual brush head 400 further includes an optional outer perimeter retainer 450. The outer retainer 450 includes a central, cylindrically shaped opening 454. The opening 454 is sized and configured to surround the sides of the movable outer portion 426. The outer retainer 450 is stationary when mounted to the appliance, while central portion 402 and outer portion 426 are independently movable with respect to each other.

In some embodiments, the central portion 402, the outer portion 426, and the outer perimeter retainer 450 together include an attachment system configured to provide selective attachment of the brush head 400 to the head attachment portion 34 of the personal care appliance 22 and to the mounting arms 182 and 184. When attached to the personal care appliance 22 by the attachment system, the following occurs: (1) the movable central portion 402 is operatively connected to the first mounting arm 182 of the armature assembly 66, 266, 366, for example, via a drive boss, mounting disc, etc., in a manner that provides oscillating motion thereto; (2) the movable outer portion 426 is operatively connected to the second mounting arm 184 of the armature assembly 66, 266, 366, for example, via a drive boss, mounting disc, etc., in a manner that provides opposing oscillating motion thereto; and (3) the outer perimeter retainer 450 fixedly secures the brush head 400 to the head attachment portion 34 of the appliance 22. Accordingly, the attachment system in some embodiments provides a quick and easy technique for attaching and detaching the brush head 400 to the personal care appliance 22. It will be appreciated that the attachment system also allows for other personal care heads to be attached to the appliance, and allows for replacement brush heads 400 to be attached to the appliance, when desired.

In some embodiments of the present disclosure, the central portion 402 and the outer portion 426 are configured so as to have equal or near equal moments of the inertia about axis 86. In some embodiments, the centroid or approximate centroid of each brush section is centered on axis 86. Additionally, in embodiments of the present disclosure, the tufts of the central portion 402 and the tufts of the outer portion 426 are configured so as to impart equal or near equal force or to perform equal or near equal work/scrubbing of the skin between, for example, adjacent tufts to further reduce handle vibration.

Operation of the appliance 22 with dual brush head 400 detachably coupled thereto will now be described with reference to FIGS. 2, 4, and 19-21. When alternating current is supplied to the stator coil 74 from the battery powered drive circuit 48, the stator 64 generates a magnetic field of reversing polarity. As a result, the first and second armatures of the oscillating motor are driven in opposing, oscillating arcuate paths about axis 86 due to the attractive/repulsive action between the magnetic field of reversing polarity generated by the stator 64 and the polarity of the magnetic devices. As the first and second armatures are driven counter to one another, the first and second armatures impart counter-oscillating movement to the central portion 402 and the outer portion 426 of the brush head 400.

In some embodiments, the collective mass moment of inertia about axis 86 of the first armature and the first inertial device is equal to the collective mass moment of inertia about axis 86 of the second armature and the second inertial device. Accordingly, as the first armature drives the first inertial device to oscillate counter to second inertial device driven by the second armature, the mass moment of inertia generated by the first armature and first inertial device, collectively, is substantially offset in some embodiments, and canceled out in other embodiments, by the mass moment of inertia generated by the second armature and second inertial device, collectively. In some embodiments, the individual mass moment of inertia of the first armature and the first inertial device is equal to the individual mass moment of inertia of the second armature and the second inertial device, respectively. Stated differently, the mass moments of inertia of the first and second armatures about axis 86 are equal and the mass moments of inertia of the first and second inertial devices about axis 86 are equal. In other embodiments, the mass moment of inertia of the first armatures about axis 86 is different than the mass moment of inertia of the first inertial device about axis 86, and the mass moment of inertia of the second armatures about axis 86 is different than the mass moment of inertia of the second inertial device about axis 86. However, in these embodiments, as stated briefly above, the first armature and the first inertial device are configured to collectively have the same mass moment of inertia about axis 86 as the second armature and the second inertial device, collectively.

Figure 22:
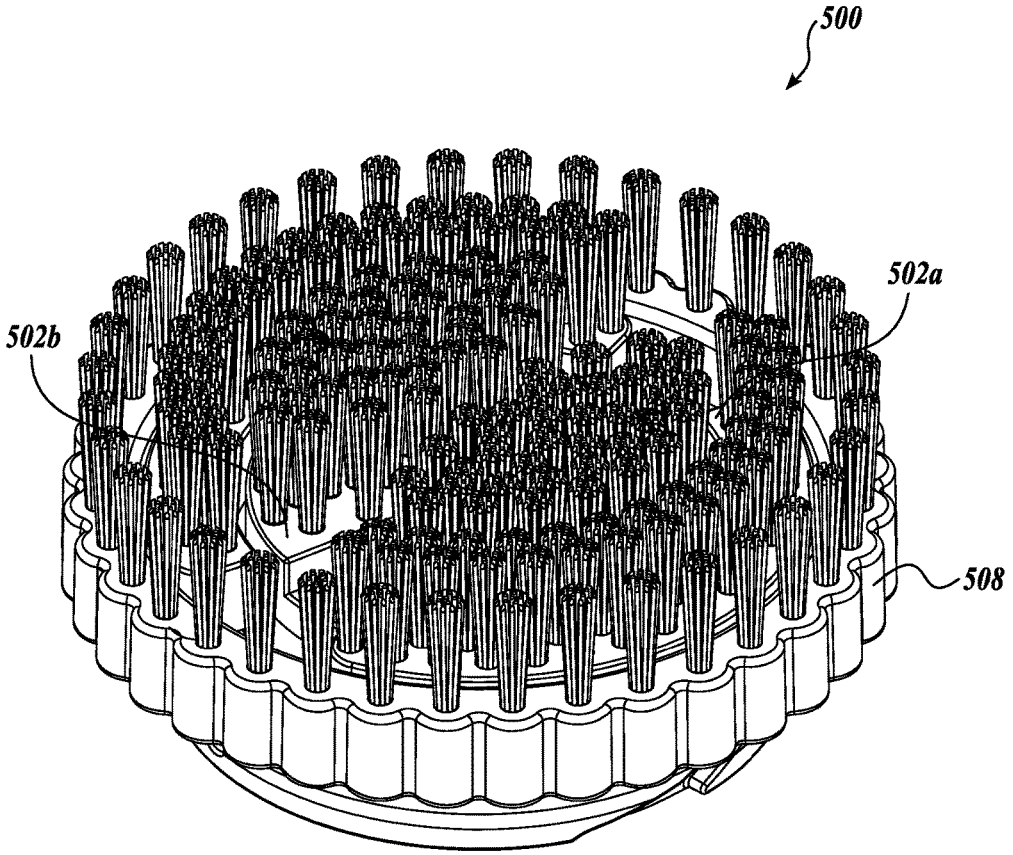
FIGS. 22-24*c* are views of another representative embodiment of a workpiece in accordance with one or more aspects of the present disclosure, which is suitable for use with the appliance of FIG. 2, the motors of FIGS. 1 and 18, and the armature assembly of FIG. 14.
Figure 23:
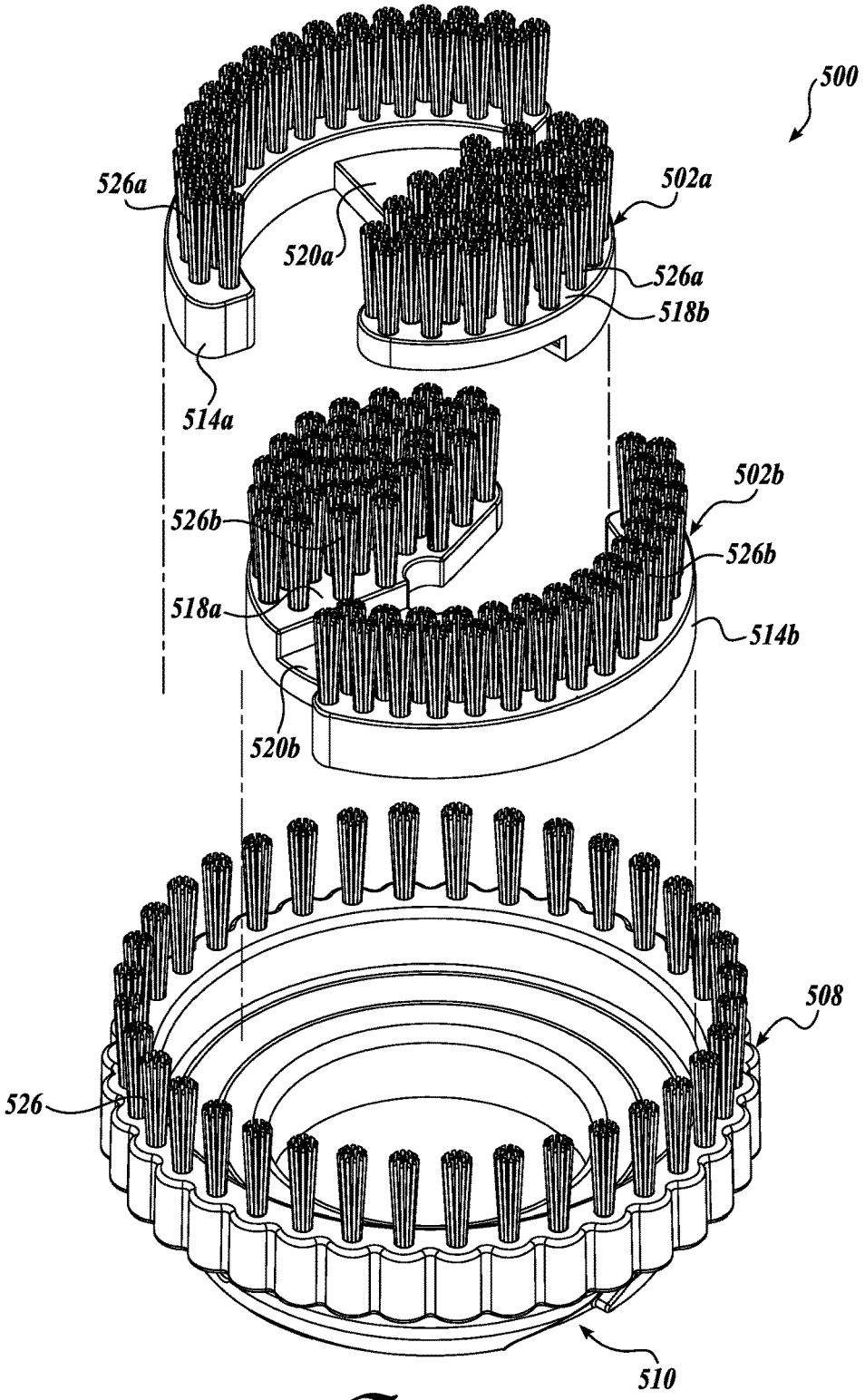

FIG. 22 illustrates another embodiment of a workpiece 500 in accordance with one or more aspects of the present disclosure. The workpiece 500 is suitable for use with the armature assemblies 66, 266, and 366 and with appliance 22 described above. As shown in FIGS. 22 and 23, the workpiece 500 includes first and second workpiece sections 502*a* and 504*b*. In the embodiment shown, the first and second workpiece sections 502*a* and 502*b* are mounted for independent, rotational movement within an optional outer retainer 508. The outer retainer 508 includes an attachment system 510 configured to be detachably coupled to the workpiece attachment portion 34 of the appliance 22. One attachment system that can be employed by the workpiece 500 is disclosed in U.S. Pat. No. 7,386,906, the disclosure of which is hereby incorporated by reference. Such an attachment system may also be used in other embodiments of the present disclosure, including brush head 400. When mounted to the appliance 22, the first and second workpiece sections 502*a* and 502*b* in some embodiments are radially symmetrical about axis 86.

Still referring to FIGS. 22 and 23, the first and second workpiece sections 502*a* and 502*b* in some embodiments are identically configured. As shown in FIG. 23, each workpiece section 502 includes an arcuate arm member 514 spaced from a wedge-like member 518. In the embodiment shown, the arcuate arm member 514 is connected to the wedge-like member 518 via a semi-circular disk member 520. Each workpiece section also includes an applicator in the form of one or more groups of bristled tufts 526. The tufts 526 are spaced apart from one another and include a plurality (e.g., 120-180) of bristles. In some embodiments, the materials and dimensioning of the bristles of tufts 526 are substantially identical to the bristles described above with regard to tufts 416. In the embodiment shown, groups of tufts 526 are mounted to both the arm member 514 and the wedge-like member 518. In some embodiments, the tufts 526*a* of the first workpiece section 502*a* and the tufts 526*b* of the second workpiece section 502*b* are configured and arranged so as to impart equal or near equal force or to perform equal or near equal work/scrubbing of the skin. In some embodiments, the outer retainer 508 can optionally include a plurality of spaced apart tufts 526.

Figure 24A:
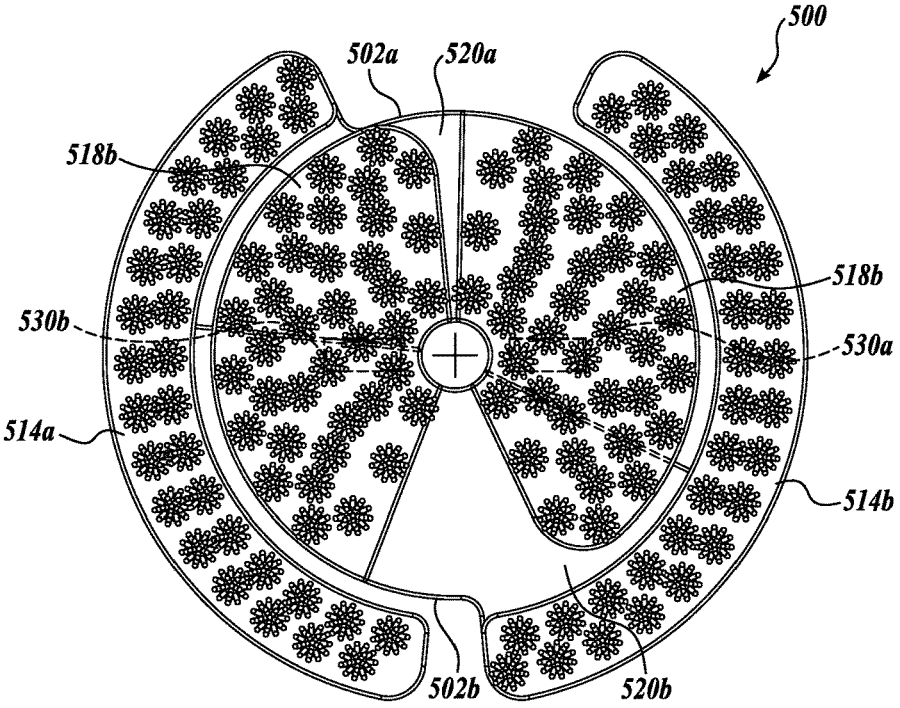
Figure 24B:
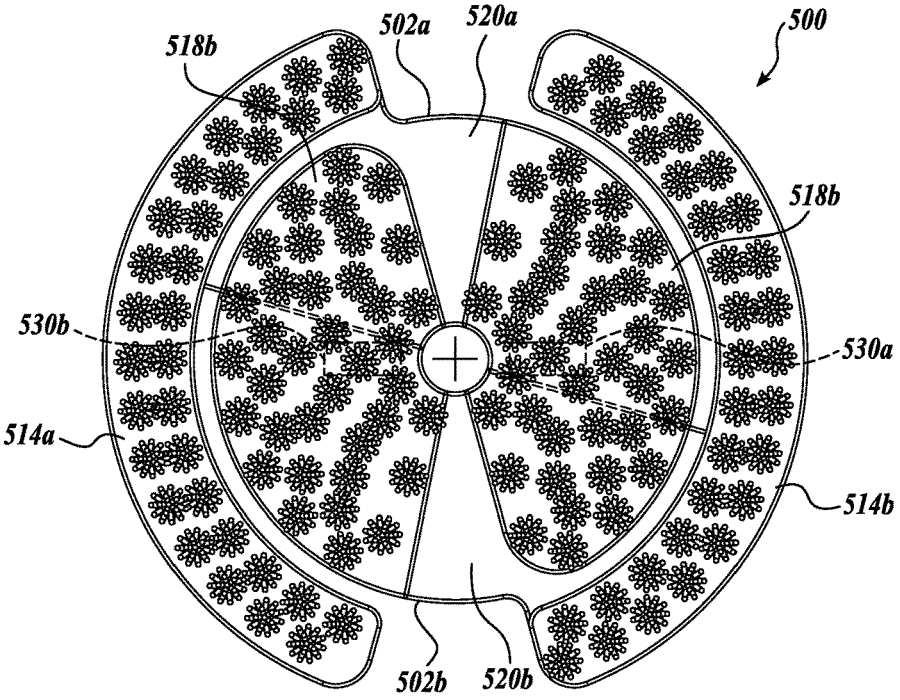
Figure 24C:
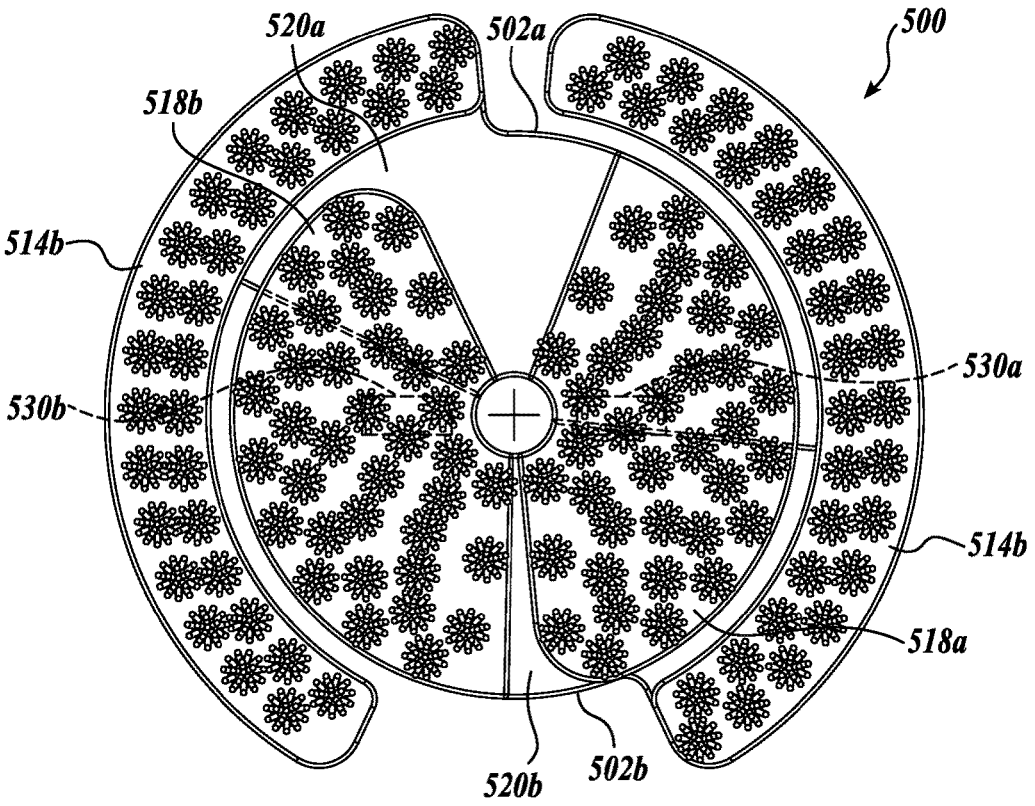

Each workpiece section 502 further includes a mounting interface, such as a socket 530, for coupling to the first and second device mounts 182 and 184 (see FIG. 2) of an oscillating motor. When mounted to the device mounts 182 and 184, the first and second workpiece sections 502*a* and 502*b* are configured to interleave with one another and move in a counter-oscillating manner about axis 86, as shown in FIGS. 24*a*-24*c*.

It should be noted that for purposes of this disclosure, terminology such as "upper," "lower," "vertical," "horizontal," "inwardly," "outwardly," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. The term "about," "approximately," "substantially," "near" etc., means plus or minus 5% of the stated value or condition.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A workpiece, comprising:

an outer section configured to be removably connected to a powered appliance, the power appliance having dual armatures; and an inner section assembly nested within the outer section, the inner section assembly including first and second inner section members independently rotatable with respect to one another and to the outer section, wherein the first and second section members are configured to cooperate with one another as the section members are driven in a counter-oscillating manner, wherein the inner section assembly is configured to be driven by movement of the dual armatures when the outer section is connected to the powered appliance.

2. The workpiece of claim 1, wherein the first and second inner section members each include a plurality of bristled tufts.

3. The workpiece of claim 1, wherein the mass moment of inertias of first and second section members are substantially equal and are centered on a common axis of rotation.

4. The workpiece of claim 1, wherein the first and second section members are configured to impart equal force onto a surface to be treated.

5. The workpiece of claim 1, wherein the first and second inner section members each include a plurality of tufts each comprising a plurality of bristles, wherein the plurality of tufts are spaced apart to form a pattern, the pattern of the first inner section being identical to the pattern of the second inner section.

6. The workpiece of claim 1, wherein the first and second inner section members are radially symmetrical about a central axis of the workpiece.

7. The workpiece of claim 1, wherein the inner section assembly is symmetrical about a plane that bisects the workpiece.

8. The workpiece of claim 1, wherein the second inner section nests within the first inner section.

9. The workpiece of claim 1, wherein the first and second inner sections are cooperatively configured to interleave with one another as each inner section oscillates.

10. A workpiece, comprising, an outer section having an internal cavity, wherein the outer section includes an appliance connection interface and a first applicator connection interface;

a first applicator section disposed within the internal cavity, the first applicator section including a drive interface, a second applicator connection interface, and an outer section connection interface, wherein the outer section connection interface is configured to cooperate with the first applicator connection interface such that the first applicator section is retained in the internal cavity and permitted to rotate about an axis independently of the outer section;

a second applicator section disposed within the internal cavity, the second applicator section including a first applicator section connection interface and a drive interface, wherein the first applicator section connection interface of the second applicator section is configured to cooperate with the second applicator connection interface of the first applicator section such that the second applicator section is retained in the internal cavity and permitted to rotate about said axis independently of the first applicator section.

11. The workpiece of claim 10, wherein the drive interfaces of the first and second applicator sections are configured to interface with dual counter-oscillating armatures of an appliance when the appliance connection interface of the outer section interfaces with the appliance.

12. The workpiece of claim 11, wherein the first applicator section and the second applicator section are cooperatively configured to interleave with one another as each applicator section oscillates opposite with one another.

13. The workpiece of claim 11, wherein the second applicator section is configured to nest within the first applicator section.

14. The workpiece of claim 11, wherein the first and second applicator sections each include a plurality of bristled tufts.

15. The workpiece of claim 11, wherein the mass moment of inertias of the first and second applicator sections are substantially equal and are approximately centered on a common rotational axis.

16. The workpiece of claim 11, wherein the first and second applicator sections are configured to impart equal force onto a surface to be treated.

* * * * *